US010543608B2

(12) United States Patent
Sakon et al.

(10) Patent No.: US 10,543,608 B2
(45) Date of Patent: Jan. 28, 2020

(54) ELECTRIC SHAVER AND OUTER BLADE USED IN THE ELECTRIC SHAVER

(71) Applicant: PANASONIC INTELLECTUAL PROPERTY MANAGEMENT CO., LTD., Osaka (JP)

(72) Inventors: Shigetoshi Sakon, Osaka (JP); Shintaro Matsuo, Shiga (JP); Kenji Narita, Osaka (JP); Shigeru Tatsuta, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 172 days.

(21) Appl. No.: 15/620,452

(22) Filed: Jun. 12, 2017

(65) Prior Publication Data

US 2017/0361478 A1 Dec. 21, 2017

(30) Foreign Application Priority Data

Jun. 16, 2016 (JP) ..... 2016-119893

(51) Int. Cl.

| | |
|---|---|
| ***B26B 19/04*** | (2006.01) |
| ***B26B 19/42*** | (2006.01) |
| ***B26B 19/06*** | (2006.01) |
| ***B26B 19/28*** | (2006.01) |

(52) U.S. Cl.

CPC ..... *B26B 19/42* (2013.01); *B26B 19/063* (2013.01); *B26B 19/282* (2013.01)

(58) Field of Classification Search

CPC ... B26B 19/042; B26B 19/063; B26B 19/282; B26B 19/384; B26B 19/3846; B26B 19/42

See application file for complete search history.

(56) References Cited

U.S. PATENT DOCUMENTS

| | | | |
|---|---|---|---|
| 2,238,886 | A | 4/1941 | Jensen |
| 2,273,524 | A | 2/1942 | Jensen et al. |
| 2,292,858 | A | 8/1942 | Alexay |
| 2,360,679 | A | 10/1944 | Holsclaw |
| 2005/0274019 | A1 | 12/2005 | Inoue et al. |

(Continued)

FOREIGN PATENT DOCUMENTS

| | | | |
|---|---|---|---|
| JP | 10-323463 | A | 12/1998 |
| JP | 2005-349128 | A | 12/2005 |

(Continued)

OTHER PUBLICATIONS

The Extended European Search Report dated Nov. 20, 2017 for the related European Patent Application No. 17175468.2.

*Primary Examiner* — Stephen Choi
(74) *Attorney, Agent, or Firm* — McDermott Will & Emery LLP

(57) ABSTRACT

An outer blade of an electric shaver has slits. Each of the slits includes: a first slit portion; a second slit portion positioned in a displaced manner from the first slit portion in a length direction of the outer blade; and a connecting slit portion connecting the first slit portion to the second slit portion. A displacement width in the length direction of the outer blade between the first slit portion and the second slit portion is set equal to or larger than at least one of widths of connecting portions of the first slit portion and the second slit portion connected to the connecting slit portion.

16 Claims, 26 Drawing Sheets

(56) References Cited

U.S. PATENT DOCUMENTS

| | | | | |
|---|---|---|---|---|
| 2011/0179648 | A1* | 7/2011 | Sakon | B26B 19/384 30/34.2 |
| 2011/0232098 | A1 | 9/2011 | Kobayashi et al. | |
| 2016/0008993 | A1* | 1/2016 | Wong | B26B 19/384 72/332 |

FOREIGN PATENT DOCUMENTS

| | | | |
|---|---|---|---|
| JP | 4140558 | B2 | 8/2008 |
| JP | 2011-200552 | A | 10/2011 |

* cited by examiner

ELECTRIC SHAVER AND OUTER BLADE USED IN THE ELECTRIC SHAVER

RELATED APPLICATION

This application claims the benefit of Japanese Application No. 2016-119893, filed on Jun. 16, 2016, the disclosure of which Application is incorporated by reference herein.

BACKGROUND

1. Technical Field

The present disclosure relates to an electric shaver, and an outer blade used in the electric shaver.

2. Description of the Related Art

Conventionally, as an electric shaver, there has been known an electric shaver which includes, as described in Japanese Patent No. 4140558 (patent literature), an outer blade held on a body portion, and an inner blade disposed inside the outer blade in a movable manner relative to the outer blade.

In this patent literature, the electric shaver includes a slit outer blade having elongated slits in a shaving direction as the outer blade and hence, the electric shaver can shave relatively long body hair efficiently.

Further, crosspieces disposed between the slits formed in the slit outer blade are formed into a shape such that straight-line crosspiece portions are connected to each other at bent crosspiece portions disposed in middle portions of the straight-line crosspiece portions. Accordingly, when the slit outer blade is viewed from a shaving direction, a range where the slits exist is expanded. With such a configuration, when the slit outer blade is brought into contact with a skin and is made to slide on the skin in a shaving direction, a region of the skin which faces the slit can be increased and hence, body hair can be efficiently shaved.

SUMMARY

Although body hair can be shaved efficiently with the use of the above-mentioned technique on the slit outer blade, it is desirable that body hair can be shaved more efficiently.

It is an object of the present disclosure to provide an electric shaver which can shave body hair more efficiently, and an outer blade used in such an electric shaver.

The electric shaver of the present disclosure includes: an outer blade that has a predetermined length and a predetermined width, and is configured to be brought into contact with a skin; and an inner blade that is disposed on a side opposite to a side where the outer blade is brought into contact with the skin, and is displaced relative to the outer blade.

The outer blade has a plurality of slits that extend in a width direction of the outer blade and into which body hair is introduced. The slits are arranged at predetermined intervals in a length direction of the outer blade.

Each of the slits includes: a first slit portion positioned on a first end portion side of the outer blade in the width direction; a second slit portion positioned on a second end portion side of the outer blade in the width direction in a displaced manner from the first slit portion in the length direction of the outer blade; and a connecting slit portion connecting the first slit portion to the second slit portion.

A displacement width in the length direction of the outer blade between the first slit portion and the second slit portion is set equal to or larger than at least one of widths of connecting portions of the first slit portion and the second slit portion connected to the connecting slit portion.

The outer blade according to the present disclosure is used in the electric shaver described heretofore.

In this manner, according to the present disclosure, it is possible to provide an electric shaver which can shave body hair more efficiently, and an outer blade used in such an electric shaver.

DETAILED DESCRIPTION

Hereinafter, an exemplary embodiment of the present disclosure is described hereinafter with reference to the drawings. Note that, the present disclosure is not limited by this exemplary embodiment.

In the exemplary embodiment described hereinafter, the direction along which a plurality of outer blades are arranged is set as longitudinal direction (shaving direction) X, the direction along which each of the outer blades extends is set as lateral direction Y, and the vertical direction in a state where an outer blade block (head portion) is disposed such that each outer blade is directed upward is set as vertical direction Z. The description will be made by assuming a side on which a switch portion of an electric shaver is mounted as a front side in longitudinal direction X.

The directions of the slit outer blade are also described using longitudinal direction X, lateral direction Y, and vertical direction Z. That is, in a state where the slit outer blade is mounted on a body portion, the directions which agree with longitudinal direction X, lateral direction Y, and vertical direction Z of an outer blade block are defined as longitudinal direction X, lateral direction Y, and vertical direction Z of the slit outer blade.

Exemplary Embodiment

Figure 1:
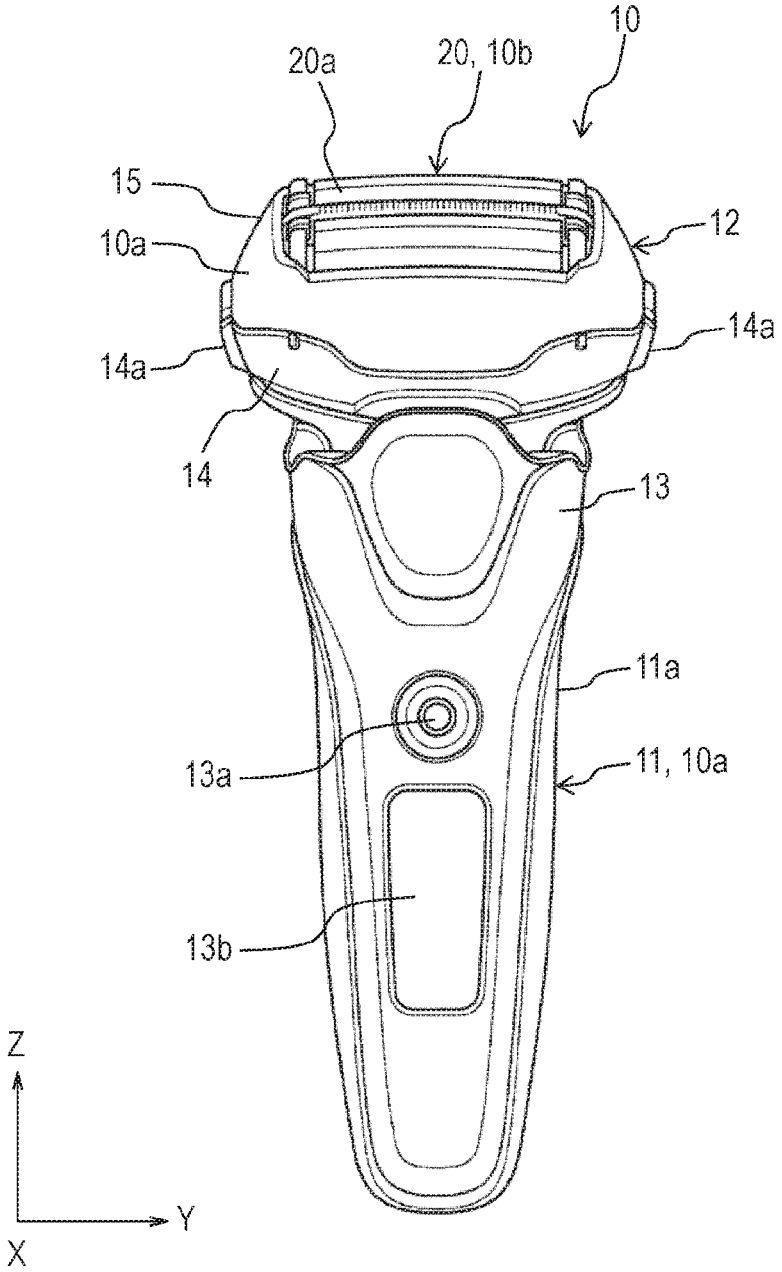
FIG. 1 is a front view showing an electric shaver according to an exemplary embodiment of the present disclosure.

As shown in FIG. 1, electric shaver 10 of this exemplary embodiment includes: gripping portion 11 having holding portion 11*a* configured to be held by a hand; and head portion 12 having blade portion 10*b* and supported by gripping portion 11.

Head portion 12 is swingable in lateral direction Y with respect to gripping portion 11 using a shaft portion (not shown in the drawing) of head portion 12 extending in longitudinal direction X as an axis. Head portion 12 is also swingable in longitudinal direction X with respect to gripping portion 11 using a shaft portion (not shown in the drawing) of head portion 12 extending in lateral direction Y as an axis. Furthermore, head portion 12 can be made liftable in vertical direction Z with respect to gripping portion 11.

Head portion 12 may be configured to be operated by optionally combining these swinging operations and lifting operations. For example, head portion 12 may be configured such that head portion 12 is liftable in vertical direction Z with respect to gripping portion 11 while being swingable in longitudinal direction X and lateral direction Y with respect to gripping portion 11.

Head portion 12 may be also configured such that head portion 12 is neither swingable nor liftable with respect to gripping portion 11.

Figure 2:
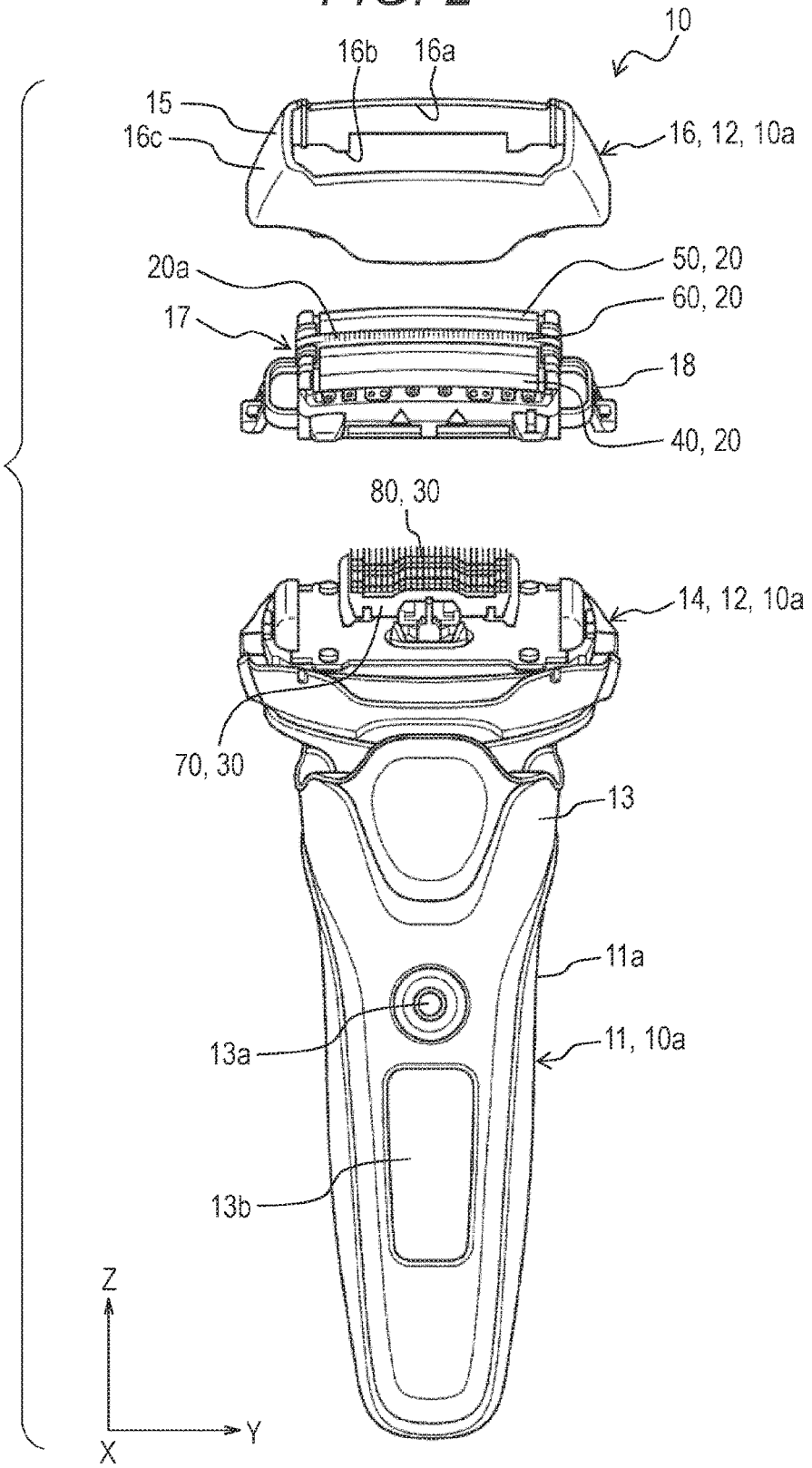
FIG. 2 is an exploded front view showing the electric shaver according to the exemplary embodiment of the present disclosure.

Electric shaver 10 includes: body portion 10*a*; outer blade 20 held by body portion 10*a* in a state where skin contact surface 20*a* is exposed; and inner blade 30 disposed inside outer blade 20 in a movable manner relative to outer blade 20 (see FIG. 1 and FIG. 2).

In this exemplary embodiment, among parts which form electric shaver 10, an assembly formed of gripping portion 11 and head portion 12 other than blade portion 10*b* is referred to as body portion 10*a*.

Gripping portion 11 includes body housing 13 having a cavity inside. Various electric parts are accommodated in the cavity formed in the inside of body housing 13.

Push-type switch portion 13*a* which operates (turns on or off a power source of) electric shaver 10 is formed on body housing 13. In this exemplary embodiment, push-type switch portion 13*a* is exemplified as a switch portion. However, the switch portion may be formed of a slide-type switch or other switches provided that a power source can be turned on or off.

In this exemplary embodiment, switch portion 13*a* is formed on a front surface of body housing 13, that is, on a front surface (front elevation surface) of electric shaver 10. The front surface of electric shaver 10 means a surface of electric shaver 10 on a side where the surface faces a user in a state where the user holds holding portion 11*a* of electric shaver 10 in a normal use state.

In this exemplary embodiment, display portion 13*b* is formed below switch portion 13*a* of body housing 13. Display portion 13*b* is provided for displaying a charge state or the like of a rechargeable battery (not shown in the drawing) incorporated in the inside of body housing 13.

A trimmer unit may be mounted on a rear portion of body housing 13 (a rear portion of electric shaver 10).

Blade portion 10*b* includes: outer blade 20 configured to be brought into contact with skin (skin surface) S; and inner blade 30 disposed at the inner side of outer blade 20 (below outer blade 20: on a side opposite to a side where outer blade 20 is brought into contact with skin S).

As shown in FIG. 1, outer blade 20 is disposed so as to be exposed to an area above head portion 12, and a portion of outer blade 20 which is exposed to the area above head portion 12 forms skin contact surface 20*a* which is brought into contact with skin (skin surface) S of a user.

In a state where power source of electric shaver 10 is turned on and then inner blade 30 disposed at the inner side of outer blade 20 (below outer blade 20: on the side opposite to the side where outer blade 20 is brought into contact with skin 5) is displaced relative to outer blade 20 (relative movement: reciprocating movement in lateral direction Y), a user slidably moves electric shaver 10 while bringing skin contact surface 20*a* of outer blade 20 into contact with skin (skin surface) S of the user, so that body hair H inserted into the inside of blade holes of outer blade 20 is cut by outer blade 20 and inner blade 30.

Next, the specific configuration of head portion 12 is described.

As shown in FIG. 1 and FIG. 2, head portion 12 includes: head portion body 14 mounted on gripping portion 11; and outer blade block 15 detachably mounted on head portion body 14. In this exemplary embodiment, head portion body 14 has, on both left and right ends thereof, release buttons 14*a* in an extendible and retractable manner. Mounting of outer blade block 15 on head portion body 14 is released by pushing release buttons 14*a* toward the inside of head portion body 14.

Head portion body 14 accommodates a drive mechanism not shown in the drawing. As the drive mechanism, it is possible to use a known drive mechanism, such as a vibration-type linear actuator or a drive mechanism formed of a rotary motor and a converting mechanism that converts a rotating motion of the rotary motor into a reciprocating linear motion, for example.

On the other hand, as shown in FIG. 2, outer blade block 15 includes approximately cylindrical outer blade holding member 16 in which outer blades 20 are mounted in an upwardly and downwardly movable manner (in a liftable manner).

Outer blade holding member 16 includes approximately cylindrical peripheral wall portion 16*c* having upper opening 16*a* and lower opening 16*b*.

Box-shaped outer blade cassette 17 which supports outer blades 20 in an upwardly and downwardly movable manner is formed. By mounting outer blade cassette 17 in outer blade holding member 16 in such a manner that outer blade cassette 17 is accommodated into outer blade holding member 16 from below outer blade holding member 16, outer blades 20 are mounted on outer blade holding member 16 in an upwardly and downwardly movable manner.

In this exemplary embodiment, outer blade cassette 17 supports the plurality of outer blades 20 arranged in longitudinal direction X.

To be more specific, outer blades 20 include first net blade 40, slit outer blade 60, and second net blade 50. First net blade 40, slit outer blade 60, and second net blade 50 are arranged in longitudinal direction X (see FIG. 2). It is needless to say that kinds of outer blades, the number of outer blades, and the manner of arrangement of the outer blades shown in FIG. 2 merely provide one example, and a combination of kinds of outer blades, the number of outer blades, the manner of arrangement of the outer blades and the like can be changed as desired.

Both first net blade 40 and second net blade 50 are formed by being bent into an inverted U shape along longitudinal direction X such that upper portions of first net blade 40 and second net blade 50 project upward as viewed in a side view (a state where the outer blade is viewed in lateral direction Y). First net blade 40 and second net blade 50 are formed by being slightly bent along lateral direction (the length direction of the outer blade) Y such that the upper portions of first net blade 40 and second net blade 50 project upward as viewed in a front view (a state where the outer blade is viewed in longitudinal direction X). In this exemplary embodiment, first net blade 40 and second net blade 50 are bent such that the upper portions of first net blade 40 and second net blade 50 project upward as viewed in a front view. However, it is not always necessary that first net blade 40 and second net blade 50 be formed in a bending manner.

First net blade 40 and second net blade 50 each have a large number of circular blade holes (not shown in the drawing), for example.

Slit outer blade 60 is provided for shaving long grown out body hair H which is difficult to shave by first net blade 40 or second net blade 50. As shown in FIG. 3 to FIG. 6, slit outer blade 60 is formed by being bent into an approximately U shape along longitudinal direction X. To be more specific, slit outer blade 60 is disposed such that slit outer blade 60 has a narrow width in longitudinal direction X and a long length in lateral direction Y. Slit outer blade 60 has an approximately inverted U shape in cross section which projects toward the skin S side. As described above, in this exemplary embodiment, slit outer blade 60 which is configured to be brought into contact with skin (skin surface) S has a predetermined length and a predetermined width. Slit outer blade 60 is disposed in a state where the length direction of slit outer blade 60 substantially agrees with lateral direction Y of electric shaver 10, and the width direction of slit outer blade 60 substantially agrees with longitudinal direction X of electric shaver 10.

Slit outer blade 60 includes: flat ceiling wall 61 facing skin (skin surface) S; and a pair of side walls 62 (first side wall 62*b* and second side wall 62*c*) that are connected to both end portions of ceiling wall 61 in longitudinal direction (the width direction of the outer blade) X respectively, extend to the slit inner blade 90 side (in the direction away from skin 5), and face each other in longitudinal direction X.

Further, slit outer blade 60 is formed such that slits (blade holes formed in outer blade 20) 300 are formed in slit outer blade 60 in an extending manner from flat ceiling wall 61 to side walls 62. That is, slits 300 are formed in an extending manner from first side wall 62*b* to second side wall 62*c* in longitudinal direction X of slit outer blade 60.

As described above, in this exemplary embodiment, slits 300 have an elongated slit shape, and have a length and a width. Slits 300 are formed such that the length direction of slit 300 (the length direction of the slit) substantially agrees with the width direction of slit outer blade 60 (the width direction of the outer blade).

Accordingly, slits 300 are formed such that the length direction of slit 300 (the length direction of the slit) substantially agrees with longitudinal direction X of electric shaver 10, and the width direction of slit 300 (the width direction of the slit) substantially agrees with lateral direction Y of electric shaver 10.

In this exemplary embodiment, a plurality of slits 300 are formed such that slits 300 are substantially equidistantly arranged in lateral direction (the length direction of the outer blade: the width direction of the slit) Y at a predetermined pitch (at predetermined intervals). Crosspiece 210 extending in longitudinal direction X is formed between each two slits 300 disposed adjacently to each other along slits 300. Crosspieces 210 also extend from flat ceiling wall 61 to side walls 62. Each crosspiece 210 has an approximately U shape formed by first side wall 62*b*, ceiling wall 61, and second side wall 62*c*.

In this exemplary embodiment, both ends 301*a*, 301*b* of slit 300 in longitudinal direction (the width direction of the outer blade: the length direction of the slit) X are formed in side walls 62 respectively. As described above, by forming both ends 301*a*, 301*b* of slit 300 in longitudinal direction (the width direction of the outer blade: the length direction of the slit) X in side walls 62, slit 300 is opened not only in the upward direction but also in both sideward directions. With such a configuration, respective slits 300 are formed in an extending manner from one end to the other end of slit outer blade 60 in longitudinal direction X without interruption. Accordingly, it is possible to introduce even relatively long body hair H into slits 300 more easily. Further, it is possible to suppress a phenomenon where body hair H is caught in crosspiece 210 so that resistance (a frictional force or the like) caused by body hair H is increased. Accordingly, deteriorating of shaving comfort can be also suppressed.

Figure 6:
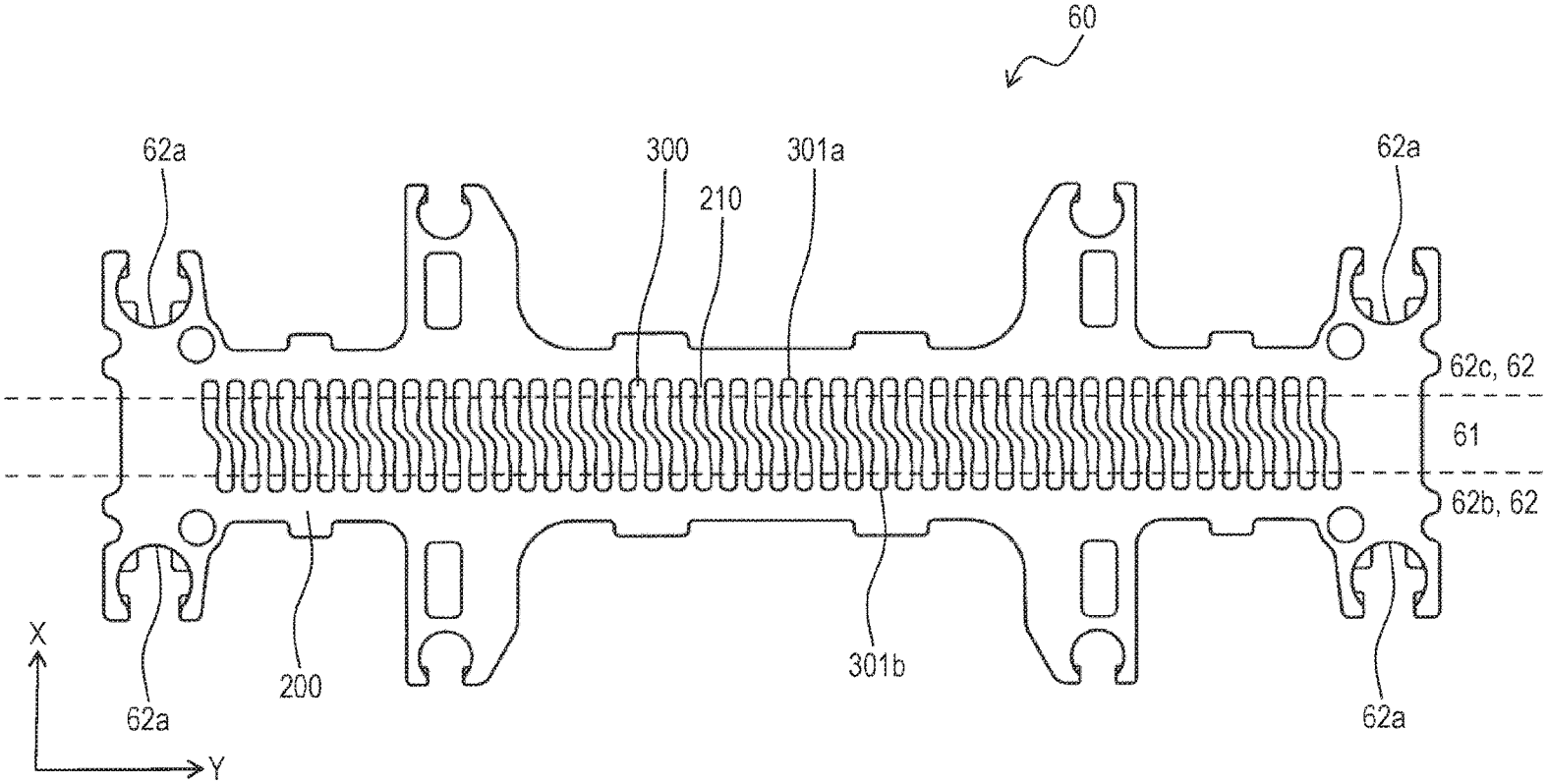
FIG. 6 is a developed plan view of the slit outer blade according to the exemplary embodiment of the present disclosure.

In this exemplary embodiment, slit outer blade 60 is formed using one metal flat plate member. To be more specific, as shown in FIG. 6, by forming the plurality of elongated slits 300 in the metal flat plate member such that slits 300 are arranged at predetermined intervals, crosspiece 210 is formed at a remaining portion of the metal plate member which exists between each two slits 300 disposed adjacently to each other. By bending portions of the metal plate member disposed more inside than both ends 301*a*, 301*b* of slits 300 in the longitudinal direction (the length direction of the slit), slit outer blade 60 which includes ceiling wall 61 and the pair of side walls 62 (first side wall 62*b* and second side wall 62*c*) is formed.

Figure 22A:
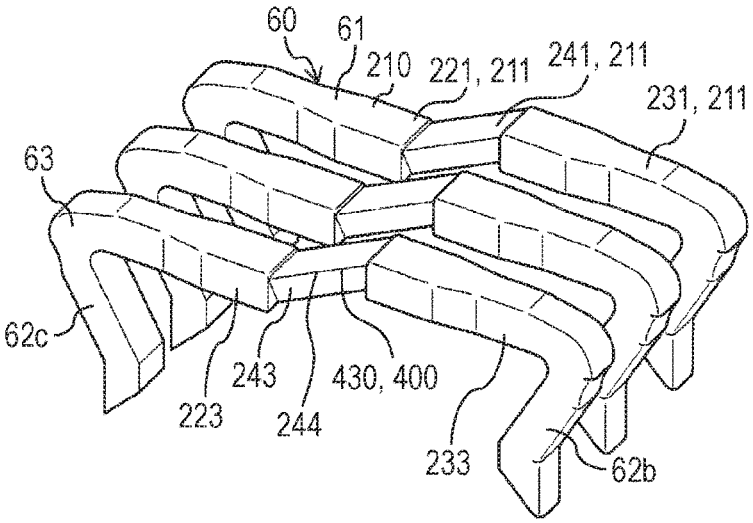
FIG. 22A is a perspective view showing a slit outer blade according to a twentieth modification of the exemplary embodiment of the present disclosure.
Figure 25A:
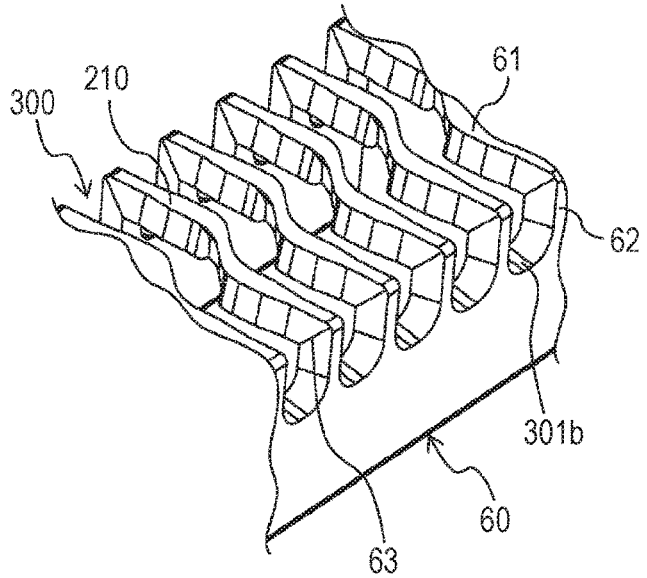
FIG. 25A is a perspective view showing the slit outer blade according to a twenty third modification of the exemplary embodiment of the present disclosure.

As shown in FIG. 22A, slit outer blade 60 may be formed into a shape where an upper portion of a bent portion formed between ceiling wall 61 and first side wall 62*b* and an upper portion of a bent portion formed between ceiling wall 61 and second side wall 62*c* each have an acute angle. As shown in FIG. 25A, slit outer blade 60 may be formed into a shape where the bending angles of the bent portions each have substantially a right angle (approximately 90°).

Inner blades 30 shown in FIG. 2 are exclusively used for first net blade 40, second net blade 50, and slit outer blade 60 which form outer blade 20.

To be more specific, at the inner sides of first net blade 40 and second net blade 50 (below first net blade 40 and second net blade 50: on the side of first net blade 40 and second net blade 50 opposite to the side where outer blade 20 is brought into contact with skin 5), inner blades (first inner blade 70 and second inner blade 80) having an inverted U shape which conforms to bent shapes of corresponding first net blade 40 and second net blade 50 are disposed (see FIG. 2).

On the other hand, at the inner side of slit outer blade 60 (below slit outer blade 60: on the side of slit outer blade 60 opposite to the side where outer blade 20 is brought into contact with skin 5), slit inner blade 90 having an approximately U shape which conforms to a bent shape of slit outer blade 60 is disposed (see FIG. 4).

Slit inner blade 90 is disposed such that slit inner blade 90 has a narrow width in longitudinal direction X and a long length in lateral direction Y. Slit inner blade 90 has an approximately inverted U shape in cross section which projects upward (toward the skin S side). Accordingly, slit inner blade 90 also has a predetermined length and a predetermined width. Slit inner blade 90 is also disposed in a state where the length direction of slit inner blade 90 substantially agrees with lateral direction Y of electric shaver 10, and the width direction of slit inner blade 90 substantially agrees with longitudinal direction X of electric shaver 10. Slit inner blade 90 is formed one size smaller than slit outer blade 60. Slit inner blade 90 is disposed such that slit inner blade 90 is embraced by slit outer blade 60.

Figure 4:
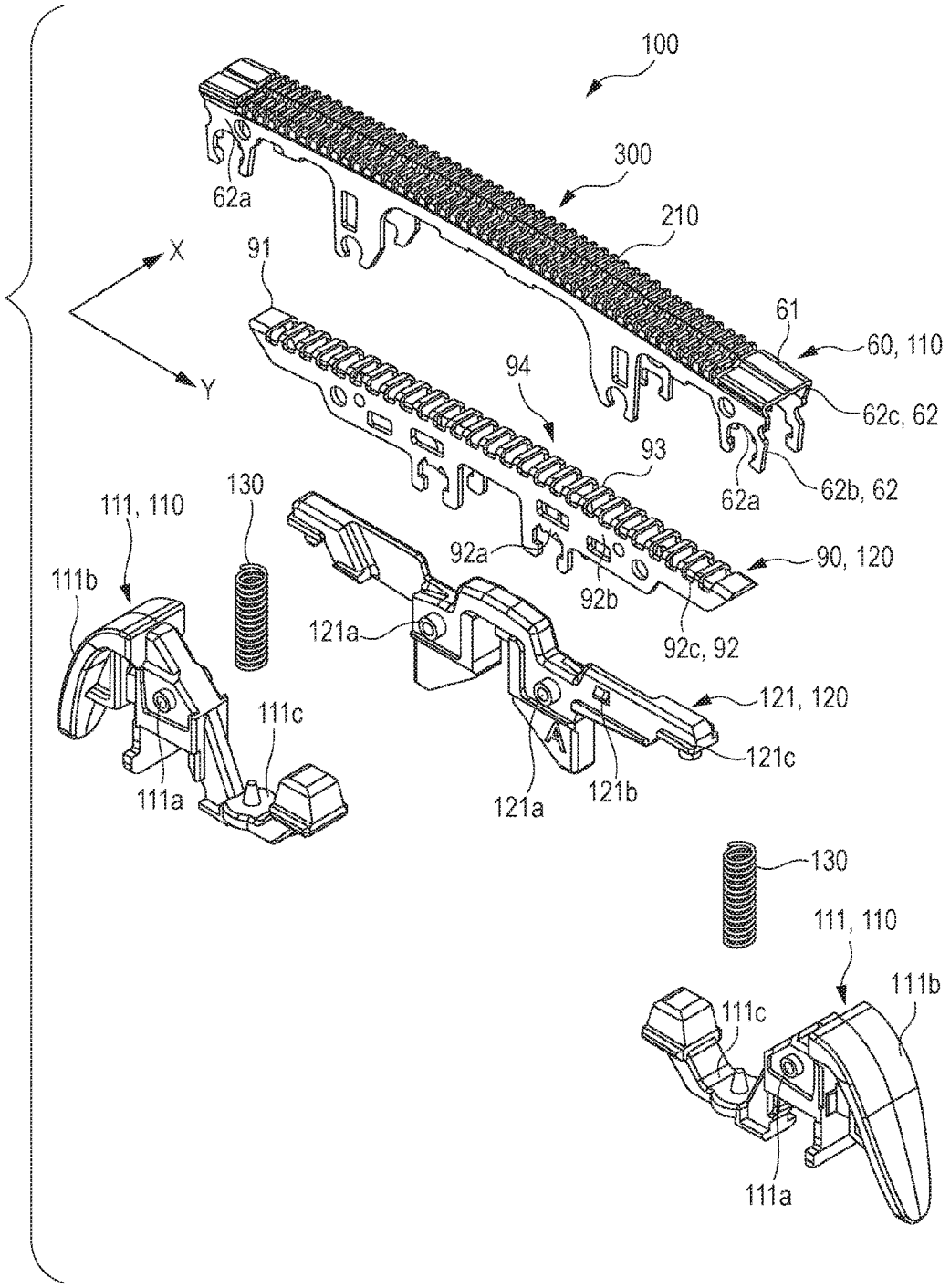
FIG. 4 is an exploded perspective view of the slit blade unit of the electric shaver according to the exemplary embodiment of the present disclosure.
Figure 5:
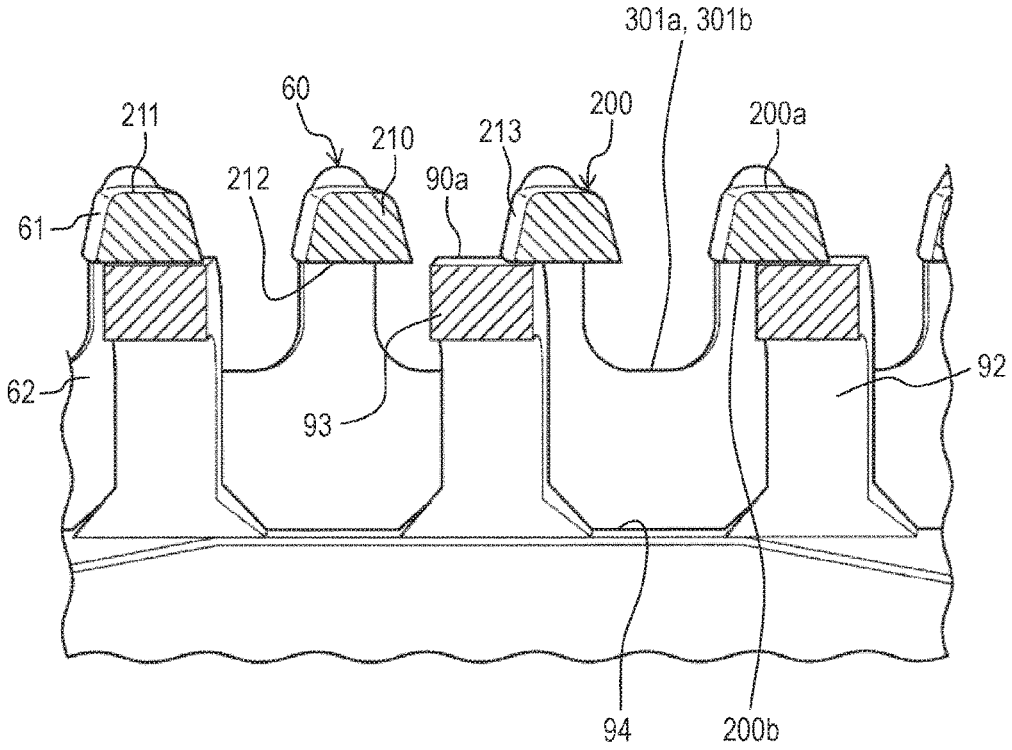
FIG. 5 is an enlarged cross-sectional view of a slit outer blade and a slit inner blade of the slit blade unit of the electric shaver according to the exemplary embodiment of the present disclosure.

As shown in FIG. 4 and FIG. 5, slit inner blade 90 includes: flat ceiling wall 91 which forms an outer surface (slide contact surface which can be brought into slide contact with slit outer blade 60) 90*a*; and a pair of side walls 92 (first side wall 92*c* and a second side wall (not shown in the drawing)) that are connected to both end portions of ceiling wall 91 in longitudinal direction (the width direction of the inner blade) X respectively, extend downward (in the direction away from skin 5), and face each other in longitudinal direction X.

Further, slit inner blade 90 is formed such that slits 94 are formed in slit inner blade 90 in an extending manner from flat ceiling wall 91 to side wall 92. That is, slits 94 are formed in an extending manner from first side wall 92*c* to the second side wall (not shown in the drawing) in longitudinal direction X of slit inner blade 90.

As described above, in this exemplary embodiment, slits 94 also have an elongated slit shape, and have a length and a width. Slits 94 are formed such that the length direction of slit 94 (the length direction of the slit) substantially agrees with the width direction of slit inner blade 90 (the width direction of the inner blade).

Accordingly, slits 94 are formed such that the length direction of slit 94 (the length direction of the slit) substantially agrees with longitudinal direction X of electric shaver 10, and the width direction of slit 94 (the width direction of the slit) substantially agrees with lateral direction Y of electric shaver 10.

In this exemplary embodiment, the plurality of slits 94 are formed such that slits 94 are substantially equidistantly arranged in lateral direction (the length direction of the inner blade: the width direction of the slit) Y at a predetermined pitch (at predetermined intervals). Crosspiece 93 extending in longitudinal direction X is formed between each two slits 94 disposed adjacently to each other along slits 94. Crosspieces 93 also extend from flat ceiling wall 91 to side walls 92. Each crosspiece 93 has an approximately U shape formed by first side wall 92*c*, ceiling wall 91, and the second side wall (not shown in the drawing). A pitch distance of slits 94 is set larger than a pitch distance of slits 300.

Both ends of slit 94 in longitudinal direction (the width direction of the inner blade: the length direction of the slit) X are also formed in side walls 92 respectively. As described above, by forming both ends of slits 94 in longitudinal direction (the width direction of the inner blade: the length direction of the slit) X in side wall 92, it is possible to suppress interference of body hair H introduced into slits 300 from lateral sides of slits 300 with side walls 92.

In the same manner as slit outer blade 60, slit inner blade 90 is also formed using one metal flat plate member.

Inner blades 30 including slit inner blade 90 shown in FIG. 2 and FIG. 4 are mounted on a drive mechanism not shown in the drawing. When the drive mechanism is driven, respective inner blades 30 are moved in a reciprocating manner in lateral direction (the length direction of the inner blade: the width direction of the slit) Y.

First inner blade 70, second inner blade 80, and slit inner blade 90 which form inner blades 30 are mounted on the drive mechanism in a separately and independently movable manner in the up-and-down direction. Respective inner blades 30 are disposed below corresponding outer blades 20 (first net blade 40, second net blade 50, and slit outer blade 60), and are moved in a reciprocating manner in lateral direction (the length direction of the inner blade: the width direction of the slit) Y. Slit inner blade 90 which forms one of inner blades 30 is disposed such that slit inner blade 90 can be brought into slide contact with inner surface 200*b* of slit outer blade 60 shown in FIG. 5.

As described above, by displacing inner blades 30 (first inner blade 70, second inner blade 80, and slit inner blade 90) disposed below (at the inner side of) outer blades 20 (first net blade 40, second net blade 50, and slit outer blade 60) shown in FIG. 2 and FIG. 4 relative to respective outer blades 20 (relative movement: movement in a reciprocating manner in lateral direction Y), outer blades 20 cut body hair H which is inserted into blade holes or slits 300 formed in respective outer blades 20 in cooperation with inner blades 30 which correspond to outer blades 20.

In this exemplary embodiment, outer blade cassette 17 is formed such that outer blade cassette 17 is mounted on outer blade frame 18 having an approximately frame shape in a state where respective outer blades 20 (first net blade 40, slit outer blade 60, and second net blade 50) are separately and independently movable in the up-and-down direction (see FIG. 2).

In this embodiment, first net blade 40, second net blade 50, and slit outer blade 60 which form outer blades 20 are mounted on dedicated outer blade frames, respectively, thus forming outer blade units. These outer blade units are made to engage with outer blade frame 18 such that these outer blade units are separately and independently movable in the up-and-down direction, thus forming outer blade cassette 17.

By mounting outer blade cassette 17 on outer blade holding member 16, first net blade 40, slit outer blade 60, and second net blade 50 are arranged in outer blade holding member 16 in this order from the front side in longitudinal direction X such that these blades are exposed upward.

In this exemplary embodiment, outer blade cassette 17 is detachably mounted on outer blade holding member 16. Outer blade cassette 17 is also detachably mounted on head portion body 14.

In this exemplary embodiment, slit inner blade 90 shown in FIG. 4 is mounted on outer blade cassette 17 such that slit inner blade 90 is movable in a reciprocating manner with respect to slit outer blade 60.

Figure 3:
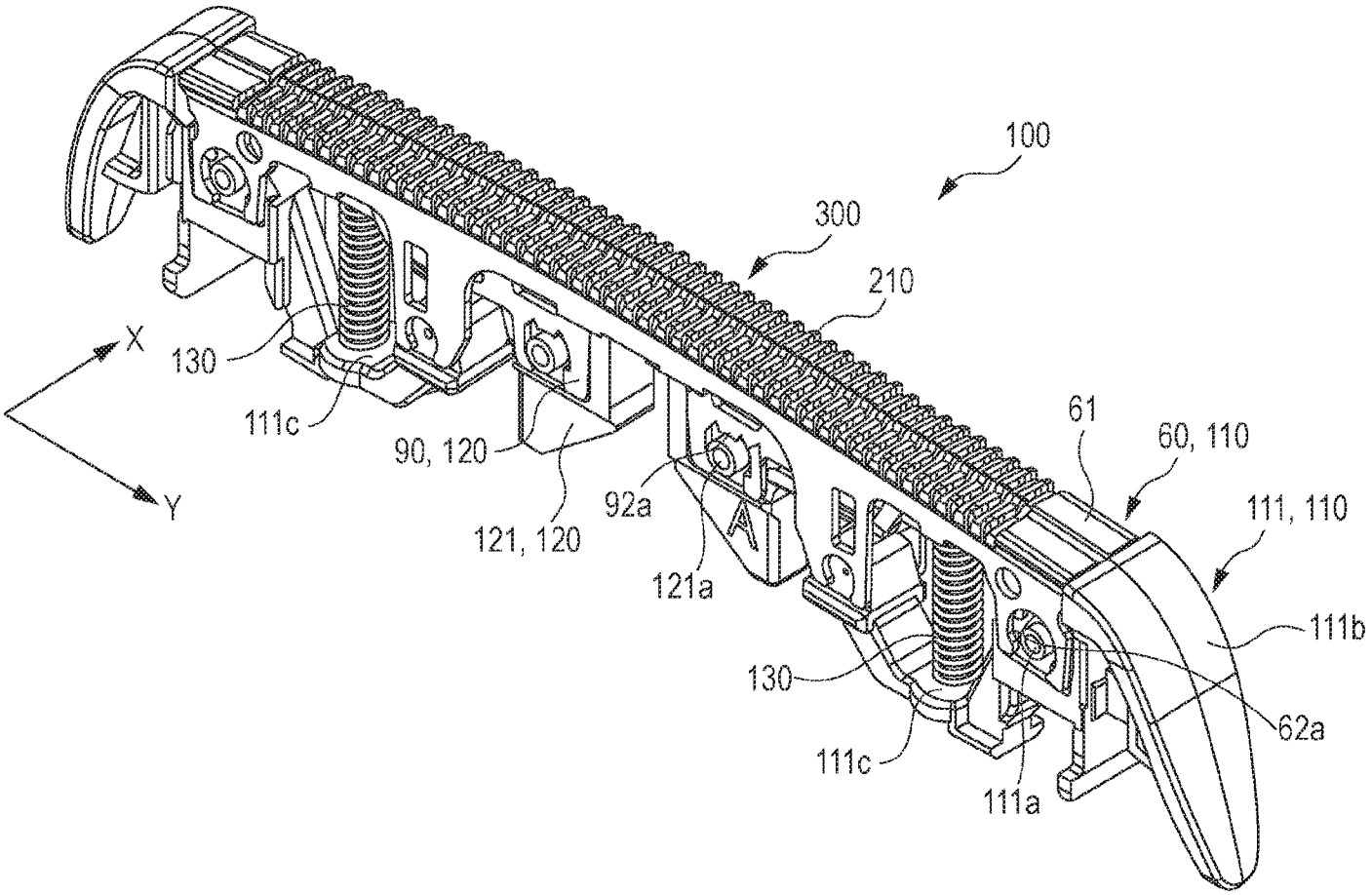
FIG. 3 is a perspective view of a slit blade unit of the electric shaver according to the exemplary embodiment of the present disclosure.

That is, in this exemplary embodiment, as shown in FIG. 3, slit outer blade 60 forms slit blade unit (one of the above-mentioned outer blade units) 100 together with slit inner blade 90.

Next, the specific configuration of slit outer blade unit 100 is described.

As shown in FIG. 4, slit outer blade unit 100 includes: slit outer blade body 110 where support members 111 are fixed to left and right end portions of slit outer blade 60, respectively; and slit inner blade body 120 where joint member 121 is fixed to slit inner blade 90. Slit outer blade unit 100 is formed such that slit outer blade body 110 is integrally formed with slit inner blade body 120 in a state where slit inner blade body 120 is brought into elastic contact with slit outer blade body 110 in the direction toward a distal end of slit outer blade body 110.

Slit outer blade bodies 110 formed of slit outer blade 60 and support members 111 are formed by applying heat sealing welding to circular-notch-shaped heat sealing recessed portions 62*a* formed in side walls 62 of slit outer blade 60 in a state where circular-columnar-shaped heat sealing bosses 111*a* formed on respective support members 111 are engaged with heat sealing recessed portions 62*a*.

On the other hand, slit inner blade body 120 formed of slit inner blade 90 and joint member 121 is formed by applying heat sealing welding to circular-notch-shaped heat sealing recessed portions 92*a* and rectangular-notch-shaped engaging holes 92*b* formed in side walls 92 of slit inner blade 90 in a state where circular-columnar-shaped heat sealing bosses 121*a* and pawl-like projecting hooks 121*b* formed on joint member 121 are engaged with heat sealing recessed portions 92*a* and engaging holes 92*b*, respectively.

By such engagement, slit outer blade unit 100 is formed where slit inner blade 90 is mounted on slit outer blade 60 such that slit inner blade 90 is movable in a reciprocating manner with respect to slit outer blade 60.

In this exemplary embodiment, cover member 111*b* which extends downward is formed on an outer side portion of each support member 111 in lateral direction Y. Spring receiving portion 111*c* oriented upward is formed on an inner side portion of each support member 111 in lateral direction Y.

Spring receiving portions 121*c* oriented downward are formed on both end portions of joint member 121 in lateral direction Y respectively.

Slit outer blade body 110 and slit inner blade body 120 are formed into an integral body in such a manner that slit inner blade 90 is inserted into slit outer blade 60 in a state where slit inner blade 90 is slidable in the lateral direction, and two slit blade pushing springs 130 are interposed between spring receiving portions 111*c* of support members 111 and spring receiving portions 121*c* of joint member 121, respectively.

In forming slit outer blade body 110 and slit inner blade body 120 into an integral body, outer surface 90*a* of slit inner blade 90 which forms a slide contact surface being slidably brought into contact with slit outer blade 60 is brought into elastic contact with inner surface 200*b* of slit outer blade 60 by slit blade pushing springs 130 (see FIG. 5).

As described above, in slit outer blade unit 100 in this exemplary embodiment, slit inner blade 90 is accommodated in the inside of slit outer blade 60 such that outer surface 90*a* of slit inner blade 90 is brought into elastic contact with inner surface 200*b* of slit outer blade 60 and slit inner blade 90 is slidable in lateral direction Y.

With such a configuration, sliding surfaces of slit outer blade 60 and slit inner blade 90 (inner surface 200*b* and outer surface 90*a*) can ensure favorable sharpness in cutting body hair H.

Next, the specific configuration of slit outer blade 60 according to this exemplary embodiment is described.

In this exemplary embodiment, as shown in FIG. 5 and FIG. 6, slit outer blade 60 which forms one of outer blades 20 includes outer blade body 200 having: skin contact surface 200*a* which is brought into contact with skin (skin surface) S; and inner surface 200*b* with which slit inner blade 90 which forms one of inner blades 30 can be brought into slide contact. Slit outer blade 60 has slits 300 which extend in longitudinal direction (the width direction of the outer blade: the length direction of the slit) X and into which body hair H is introduced. The plurality of slits 300 are formed such that slits 300 are arranged in lateral direction (the length direction of the outer blade: the width direction of the slit) Y at predetermined intervals.

As described above, between each two slits 300 which are formed in slit outer blade 60 and are disposed adjacently to each other in lateral direction (the length direction of the outer blade: the width direction of the slit) Y, each crosspiece 210 extending in longitudinal direction (the width direction of the outer blade) X is formed along slits 300. Accordingly, in this exemplary embodiment, crosspieces 210 form a part of outer blade body 200.

Peripheries of slits 300 are defined by crosspieces 210. For this reason, end edges of each crosspiece 210 on the slit 300 side form peripheral edge portions of slit 300.

In this exemplary embodiment, each slit 300 has a shape where both ends 301*a*, 301*b* of slit 300 in longitudinal direction (the width direction of the outer blade: the length direction of the slit) X are displaced from each other in lateral direction (the length direction of the outer blade: the width direction of the slit) Y.

Figure 7A:
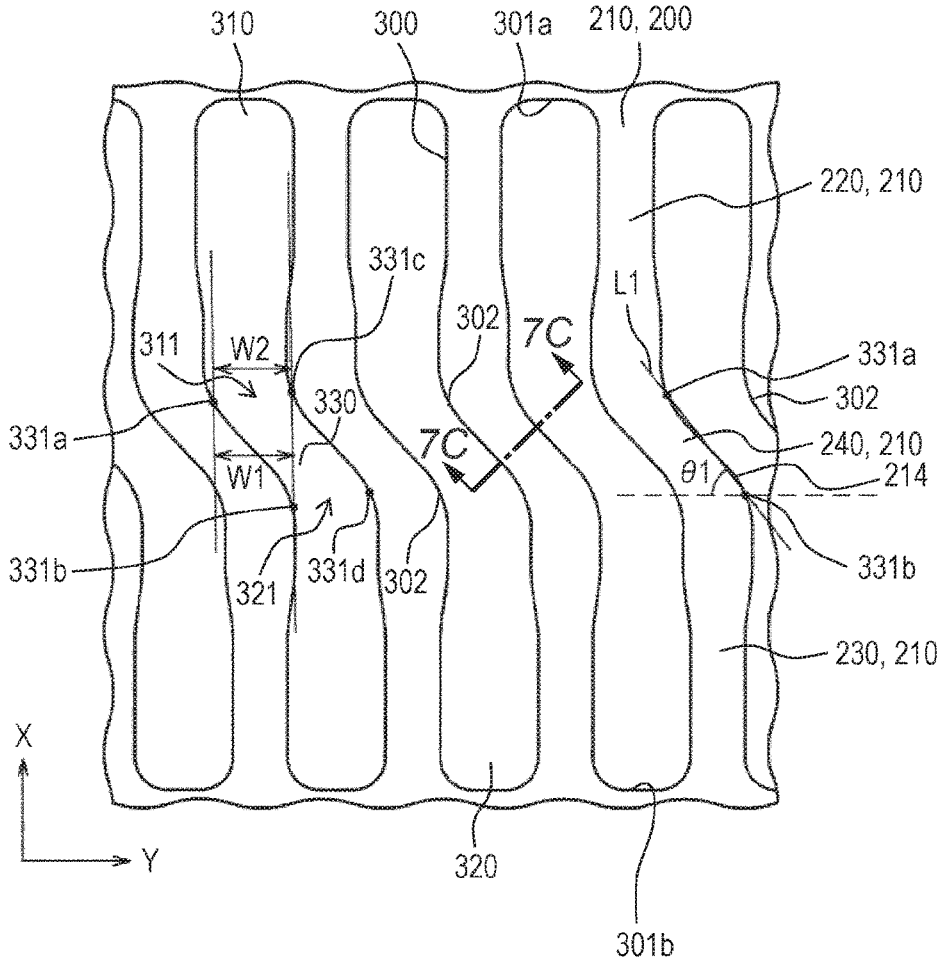
FIG. 7A is an enlarged plan view of a slit in a state where the slit outer blade according to the exemplary embodiment of the present disclosure is developed.

To be more specific, as shown in FIG. 7A, slit 300 includes first slit portion 310 which is disposed on one side in longitudinal direction (the width direction of the outer blade: the length direction of the slit) X, and extends in longitudinal direction (the width direction of the outer blade: the length direction of the slit) X.

Slit 300 also includes second slit portion 320 which is disposed on the other side in longitudinal direction (the width direction of the outer blade: the length direction of the slit) X at a position displaced from first slit portion 310 in lateral direction (the length direction of the outer blade: the width direction of the slit) Y, and extends in longitudinal direction (the width direction of the outer blade: the length direction of the slit) X.

First slit portion 310 and second slit portion 320 are connected to each other by connecting slit portion 330. Connecting slit portion 330 is formed so as to extend in the direction which intersects with longitudinal direction (the width direction of the outer blade: the length direction of the slit) X.

That is, each slit 300 includes: first slit portion 310 positioned on one end side in longitudinal direction (the width direction of the outer blade: the length direction of the slit) X; second slit portion 320 positioned on the other end side in longitudinal direction (the width direction of the outer blade: the length direction of the slit) X in a displaced manner from first slit portion 310 in lateral direction (the length direction of the outer blade: the width direction of the slit) Y; and connecting slit portion 330 connecting first slit portion 310 to second slit portion 320.

Each crosspiece 210 formed so as to extend along slits 300 having such a configuration includes first crosspiece portion 220 that is disposed adjacently to first slit portions 310 in lateral direction (the length direction of the outer blade: the width direction of the slit) Y, and extends in longitudinal direction (the width direction of the outer blade: the length direction of the slit) X.

Crosspiece 210 also includes second crosspiece portion 230 that is disposed adjacently to second slit portions 320 in lateral direction (the length direction of the outer blade: the width direction of the slit) Y, and extends in longitudinal direction (the width direction of the outer blade: the length direction of the slit) X.

First crosspiece portion 220 and second crosspiece portion 230 are connected to each other by connecting crosspiece portion 240 disposed adjacently to connecting slit portion 330. Connecting crosspiece portion 240 is formed so as to extend in the direction which intersects with longitudinal direction (the width direction of the outer blade: the length direction of the slit) X (substantially the same direction as the extending direction of connecting slit portion 330).

That is, crosspiece 210 includes: first crosspiece portion 220 disposed adjacently to first slit portions 310; second crosspiece portion 230 disposed adjacently to second slit portions 320; and connecting crosspiece portion 240 disposed adjacently to connecting slit portion 330 and configured to connect first crosspiece portion 220 to second crosspiece portion 230.

Connecting slit portion 330 has: connecting portion 331*a* disposed on one side in lateral direction (the length direction of the outer blade: the width direction of the slit) Y and on one side in longitudinal direction (the width direction of the outer blade: the length direction of the slit) X; and connecting portion 331*c* disposed on the other side in lateral direction (the length direction of the outer blade: the width direction of the slit) Y and on one side in longitudinal direction (the width direction of the outer blade: the length direction of the slit) X. Connecting slit portion 330 is connected to first slit portion 310 at connecting portion 331*a* and connecting portion 331*c*.

That is, connecting portion 331*a* forms a connecting portion of connecting slit portion 330 connected with first slit portion 310 on one side in lateral direction (the length direction of the outer blade: the width direction of the slit) Y, and connecting portion 331*b* forms a connecting portion of connecting slit portion 330 connected with second slit portion 320 on one side in lateral direction (the length direction of the outer blade: the width direction of the slit) Y.

A portion of first slit portion 310 in the vicinity of a line segment which connects connecting portion 331*a* to connecting portion 331*c* forms connecting portion 311 of first slit portion 310 connected to connecting slit portion 330 (see FIG. 7A).

Connecting slit portion 330 has: connecting portion 331*b* disposed on one side in lateral direction (the length direction of the outer blade: the width direction of the slit) Y and on the other side in longitudinal direction (the width direction of the outer blade: the length direction of the slit) X; and connecting portion 331*d* disposed on the other side in lateral direction (the length direction of the outer blade: the width direction of the slit) Y and on the other side in longitudinal direction (the width direction of the outer blade: the length direction of the slit) X. Connecting slit portion 330 is connected to second slit portion 320 at connecting portion 331*b* and connecting portion 331*d*.

That is, connecting portion 331*c* forms a connecting portion of connecting slit portion 330 connected with first slit portion 310 on the other side in lateral direction (the length direction of the outer blade: the width direction of the slit) Y, and connecting portion 331*d* forms a connecting portion of connecting slit portion 330 connected with second slit portion 320 on the other side in lateral direction (the length direction of the outer blade: the width direction of the slit) Y.

A portion of second slit portion 320 in the vicinity of a line segment which connects connecting portion 331*b* to connecting portion 331*d* forms connecting portion 321 of second slit portion 320 connected to connecting slit portion 330 (see FIG. 7A).

In this exemplary embodiment, displacement width W1 between first slit portion 310 and second slit portion 320 in lateral direction (the length direction of the outer blade: the width direction of the slit) Y is set equal to or larger than width W2 of connecting portion 311, 321 (at least one of the connecting portion of first slit portion 310 and the connecting portion of second slit portion 320) connected to connecting slit portion 330.

To be more specific, connecting slit portion 330 is formed such that displacement width W1 in lateral direction Y of a line segment which connects connecting portion 331*a* to connecting portion 331*b* becomes equal to or larger than width W2 in lateral direction Y of the line segment which connects connecting portion 331*a* to connecting portion 331*c*.

In this exemplary embodiment, as shown in FIG. 7A, connecting slit portion 330 is formed such that displacement width W1 and width W2 are equal to each other (W1=W2).

With such a configuration, when slits 300 are viewed in longitudinal direction (the width direction of the outer blade: the length direction of the slit) X, portions of slits 300 each of which is disposed between connecting portion 331*a* and connecting portion 331*c* are concealed by connecting crosspiece portions (peripheral edge portions of crosspieces 210 on one side in lateral direction Y of connecting slit portions 330) 240.

As a result, when slit outer blade 60 is moved in longitudinal direction (the width direction of the outer blade: the length direction of the slit) X in a state where body hair H lying flat against skin S is introduced into first slit portion 310, body hair H lying flat against skin S is brought into contact with connecting crosspiece portions 240 so that body hair H lying flat against skin S can be lifted and cut with more certainty.

In this exemplary embodiment, each connecting slit portion 330 is formed such that an angle made by connecting slit portion 330 and lateral direction (the length direction of the outer blade: the width direction of the slit) Y is set to a value which falls within a range from 0° to 45° inclusive.

That is, angle θ1 made by straight line L1 which connects connecting portion 331*a* to connecting portion 331*b* and lateral direction (the length direction of the outer blade: the width direction of the slit) Y is set to a value which falls within a range from 0° to 45° inclusive. In this exemplary embodiment, angle θ1 is set to 45° (angle θ1=45°).

Assume a case where angle θ1 is set to 45° or more, for example. In such a case, even when body hair H is brought into contact with skin contact surface side end portion 214 of connecting slit portion 330, there is a possibility that body hair H is moved along skin contact surface side end portion 214 as is (lateral sliding) so that body hair H is not lifted. For this reason, angle θ1 is preferably set equal to or less than 45°.

By setting angle θ1 to a value closer to 0°, a hair lifting effect brought about by skin contact surface side end portion 214 can be further enhanced.

However, in the case where angle θ1 is set to a value closer to 0°, when slit outer blade 60 is moved in longitudinal direction (the width direction of the outer blade: the length direction of the slit) X, a frictional resistance caused by a contact between body hair H and skin contact surface side end portion 214 is increased. Accordingly, there may be a case where body hair H is prevented from smoothly sliding along skin contact surface side end portion 214.

Accordingly, to smoothly introduce body hair H into a cut portion with a small frictional resistance while enhancing a hair lifting effect brought about by connecting crosspiece portion 240, it is preferable to set angle θ1 to a value which falls within a range from 30° to 45° inclusive.

In this exemplary embodiment, bent portion 302 is formed on a connecting portion (at least one of connecting portion 311 and connecting portion 321) between at least one of first slit portion 310 and second slit portion 320 and connecting slit portion 330 as viewed from a side where slit outer blade 60 is brought into contact with skin S.

That is, in a state where slit outer blade 60 is viewed from skin contact surface 200*a* side, bent portions 302 are formed at end portions (connecting portions 331*a* to 331*d*) of each connecting slit portion 330 in longitudinal direction (the width direction of the outer blade: the length direction of the slit) X. It is preferable that a radius of curvature of bent portion 302 be set to a value which falls within a range from 0.1 mm to 0.5 mm inclusive.

As described above, by forming bent portion 302, it is possible to suppress a phenomenon where body hair H introduced into first slit portion 310 or second slit portion 320 is caught in connecting portion 311, 321 and hence, body hair H in slit 300 can be moved more smoothly. By forming connecting portion 311, 321 into a smoothly curved shape, it is also possible to reduce stimulus to skin (skin surface) S.

In this exemplary embodiment, each crosspiece 210 shown in FIG. 5 has: skin contact surface (outer surface) 211 configured to be brought into contact with skin (skin surface) S; inner surface 212 which faces slit inner blade 90 below skin contact surface (outer surface) 211 (on the side opposite to the outer surface); and side surfaces 213 which connect skin contact surface (outer surface) 211 to inner surface 212.

Figure 7B:
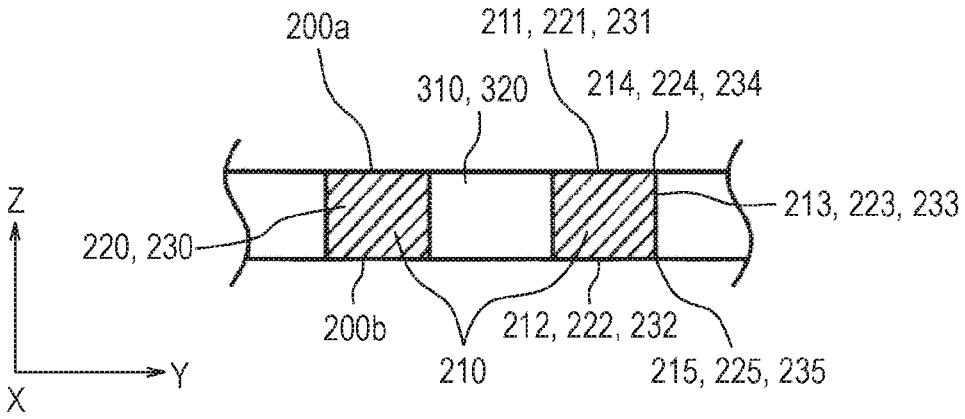
FIG. 7B is an enlarged cross-sectional view of the slit outer blade according to the exemplary embodiment of the present disclosure including first crosspiece portions and second crosspiece portions extending in a longitudinal direction of the slit outer blade.
Figure 7C:
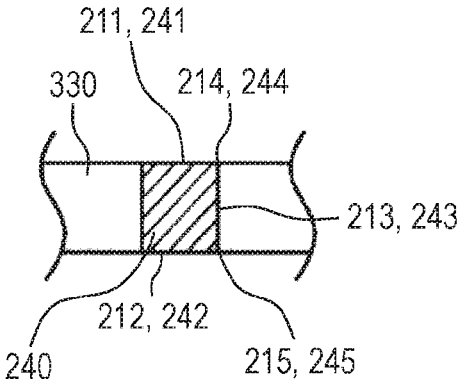
FIG. 7C is a cross-sectional view taken along line 7C-7C in FIG. 7A.

In this exemplary embodiment, as shown in FIG. 7B and FIG. 7C, crosspiece 210 is formed into an approximately quadrangular shape in cross section taken along a plane parallel to vertical direction Z and orthogonal to an extending direction of crosspiece 210. Accordingly, both skin contact surface side end portions 214 and inner surface side end portions 215 of crosspiece 210 form edge portions (corner portions) having substantially a right angle.

FIG. 7B shows a cross-sectional shape of first crosspiece portion 220 and second crosspiece portion 230 (a cross-sectional shape taken along a plane parallel to vertical direction Z, and parallel to the YZ plane orthogonal to the X direction along which first crosspiece portion 220 and second crosspiece portion 230 extend).

FIG. 7C shows a cross-sectional shape of connecting crosspiece portion 240 (a cross-sectional shape taken along a plane parallel to the vertical direction Z and orthogonal to the extending direction of connecting crosspiece portion 240).

That is, as shown in FIG. 7B, both first crosspiece portion 220 and second crosspiece portion 230 have: skin contact surface (outer surface) 221, 231; inner surface 222, 232; and side surfaces 223, 233. Both skin contact surface side end portions 224, 234 and inner surface side end portions 225, 235 of first crosspiece portion 220 and second crosspiece portion 230 form edge portions (corner portions) having substantially a right angle.

On the other hand, as shown in FIG. 7C, connecting crosspiece portion 240 has: skin contact surface (outer surface) 241; inner surface 242; and side surfaces 243. Both skin contact surface side end portions 244 and inner surface side end portions 245 of connecting crosspiece portion 240 form edge portions (corner portions) having substantially a right angle.

As described above, in this exemplary embodiment, an angle made by inner surface 242 of connecting crosspiece portion 240 and whole (a part of or whole) side surface 243 of connecting crosspiece portion 240 is set to 90° (90° or more).

In this exemplary embodiment, in a region of slit outer blade 60 shown in FIG. 6 where slits 300 are formed (a range from a slit at one end to a slit at the other end in lateral direction Y), when slit outer blade 60 is viewed in longitudinal direction (the width direction of the outer blade: the length direction of the slit) X, slit 300 exists at any portion of slit outer blade 60 in lateral direction (the length direction of the outer blade: the width direction of the slit) Y. That is, in the region where slits 300 are formed, when slit outer blade 60 is cut along a plane (XZ plane) orthogonal to lateral direction Y, there is no portion where only crosspiece 210 is formed within a range from first side wall 62*b* to second side wall 62*c*.

With such a configuration, when slit outer blade 60 is moved in longitudinal direction (the width direction of the outer blade: the length direction of the slit) X, during a period of movement of slit outer blade 60 from start to finish, all skin (skin surface) S which faces the region where slits 300 are formed are made to face slit 300 at any stage. As a result, body hair H on skin (skin surface) S can be cut more efficiently.

In this exemplary embodiment, each slit 300 is formed in approximately point symmetry with respect to the center of slit 300.

Accordingly, even when slit outer blade 60 is moved in either direction in longitudinal direction (the width direction of the outer blade: the length direction of the slit) X, the above-mentioned advantageous effect can be acquired.

Next, modifications of slit outer blade 60 which forms one of outer blades 20 are described.

For example, slit outer blade 60 may be formed such that slits 300 and crosspieces 210 as viewed in a top plan view (shapes of slits 300 and crosspieces 210 as viewed from a side where slit outer blade 60 is brought into contact with skin S) have shapes shown in FIG. 8A, FIG. 8B and FIG. 9A to FIG. 9C.

Figure 8A:
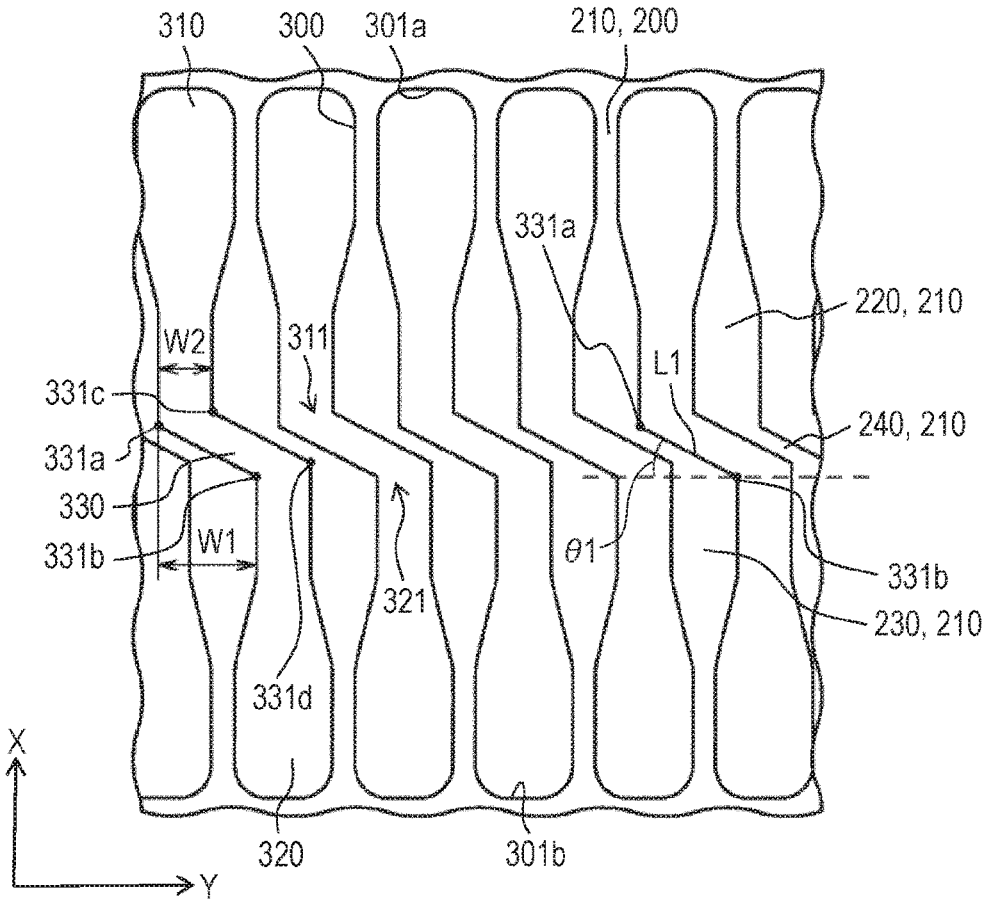
FIG. 8A is an enlarged plan view of slits in a state where a slit outer blade according to a first modification of the exemplary embodiment of the present disclosure is developed.

Each slit 300 shown in FIG. 8A also has a shape where both ends 301*a*, 301*b* of slit 300 in longitudinal direction (the width direction of the outer blade: the length direction of the slit) X are displaced from each other in lateral direction (the length direction of the outer blade: the width direction of the slit) Y.

That is, slit 300 shown in FIG. 8A also has a shape where first slit portion 310 and second slit portion 320 which is disposed at a position displaced from first slit portion 310 in lateral direction (the length direction of the outer blade: the width direction of the slit) Y are connected to each other by connecting slit portion 330.

Displacement width W1 between first slit portion 310 and second slit portion 320 in lateral direction (the length direction of the outer blade: the width direction of the slit) Y is set equal to or larger than width W2 of connecting portion 311, 321 (at least one of the connecting portion of first slit portion 310 and the connecting portion of second slit portion 320) connected to connecting slit portion 330.

To be more specific, connecting slit portion 330 is formed such that displacement width W1 in lateral direction Y of a line segment which connects connecting portion 331*a* to connecting portion 331*b* becomes equal to or larger than width W2 in lateral direction Y of the line segment which connects connecting portion 331*a* to connecting portion 331*c*. In FIG. 8A, connecting slit portion 330 is formed such that displacement width W1 is larger than width W2 of connecting portion 311, 321 (W1>W2).

Connecting slit portion 330 is formed such that an angle made by connecting slit portion 330 and lateral direction (the length direction of the outer blade: the width direction of the slit) Y is set to a value which falls within a range from 0° to 45° inclusive.

That is, angle θ1 made by straight line L1 which connects connecting portion 331*a* to connecting portion 331*b* and lateral direction (the length direction of the outer blade: the width direction of the slit) Y is set to a value which falls within a range from 0° to 45° inclusive. In FIG. 8A, angle θ1 is set to 30°.

In FIG. 8A, slit 300 is formed such that portions of slit 300 on both sides in longitudinal direction (the width direction of the outer blade: the length direction of the slit) X have a large width. With such a configuration, when slit outer blade 60 having ceiling wall 61 and pair of side walls 62 (first side wall 62*b* and second side wall 62*c*) (see FIG. 4) is formed, both side portions of slit 300 are allowed to have a large opening area. As described above, by allowing side portions of slit 300 to have a large opening area, body hair H can be easily introduced into slit 300 in longitudinal direction X.

Figure 8B:
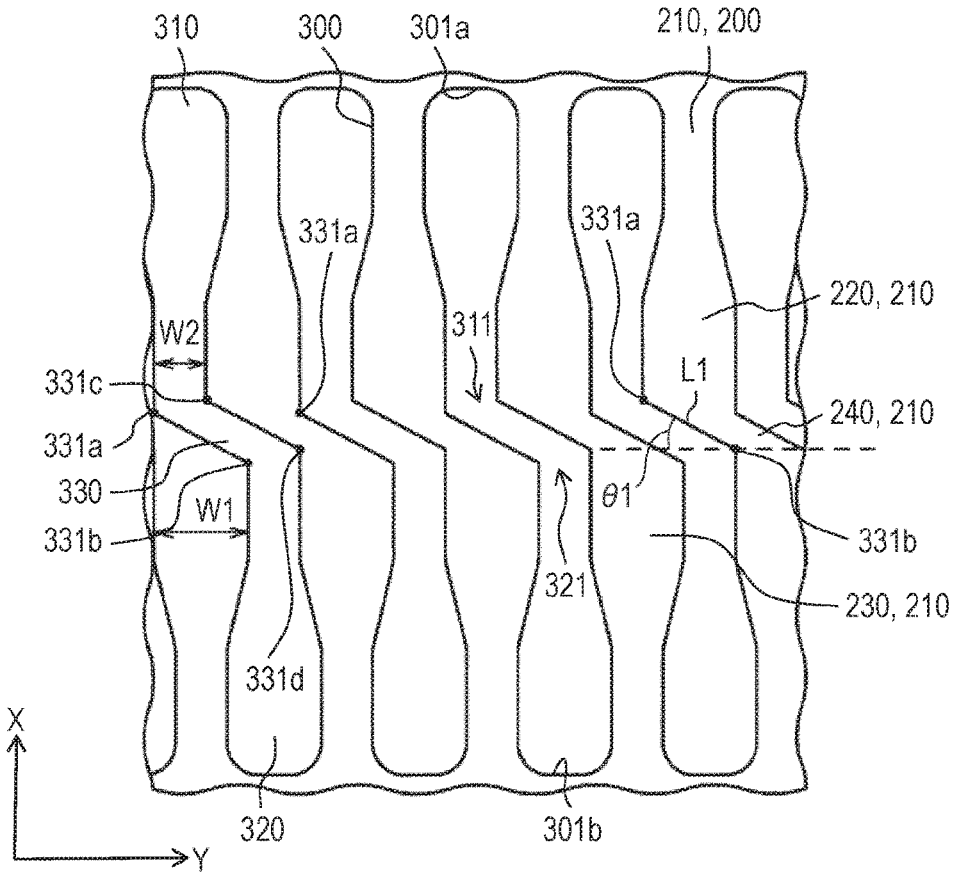
FIG. 8B is an enlarged plan view of slits in a state where a slit outer blade according to a second modification of the exemplary embodiment of the present disclosure is developed.

Each slit 300 shown in FIG. 8B also has a shape where both ends 301*a*, 301*b* of slit 300 in longitudinal direction (the width direction of the outer blade: the length direction of the slit) X are displaced from each other in lateral direction (the length direction of the outer blade: the width direction of the slit) Y.

That is, slit 300 shown in FIG. 8B also has a shape where first slit portion 310 and second slit portion 320 which is disposed at a position displaced from first slit portion 310 in lateral direction (the length direction of the outer blade: the width direction of the slit) Y are connected to each other by connecting slit portion 330.

Displacement width W1 between first slit portion 310 and second slit portion 320 in lateral direction (the length direction of the outer blade: the width direction of the slit) Y is set equal to or larger than width W2 of connecting portion 311, 321 (at least one of the connecting portion of first slit portion 310 and the connecting portion of second slit portion 320) connected to connecting slit portion 330.

To be more specific, connecting slit portion 330 is formed such that displacement width W1 in lateral direction Y of a line segment which connects connecting portion 331*a* to connecting portion 331*b* becomes equal to or larger than width W2 in lateral direction Y of the line segment which connects connecting portion 331*a* to connecting portion 331*c*. In FIG. 8B, connecting slit portion 330 is formed such that displacement width W1 is larger than width W2 of connecting portion 311, 321 (W1>W2).

Slits 300 shown in FIG. 8B are formed such that connecting portion 331*a* of connecting slit portion 330 and connecting portion 331*d* of connecting slit portion 330 disposed adjacently to the above-mentioned connecting slit portion 330 are arranged in longitudinal direction (the width direction of the outer blade: the length direction of the slit) X.

Connecting slit portion 330 is formed such that an angle made by connecting slit portion 330 and lateral direction (the length direction of the outer blade: the width direction of the slit) Y is set to a value which falls within a range from 0° to 45° inclusive.

That is, angle θ1 made by straight line L1 which connects connecting portion 331*a* to connecting portion 331*b* and lateral direction (the length direction of the outer blade: the width direction of the slit) Y is set to a value which falls within a range from 0° to 45° inclusive. Also in FIG. 8B, angle θ1 is set to 30°.

Also in FIG. 8B, slit 300 is formed such that portions of slit 300 on both sides in longitudinal direction (the width direction of the outer blade: the length direction of the slit) X have a large width. With such a configuration, when slit outer blade 60 having ceiling wall 61 and pair of side walls 62 (first side wall 62*b* and second side wall 62*c*) (see FIG. 4) is formed, both side portions of slit 300 are allowed to have a large opening area. As described above, by allowing side portions of slit 300 to have a large opening area, body hair H can be easily introduced into slit 300 in longitudinal direction X.

Figure 9A:
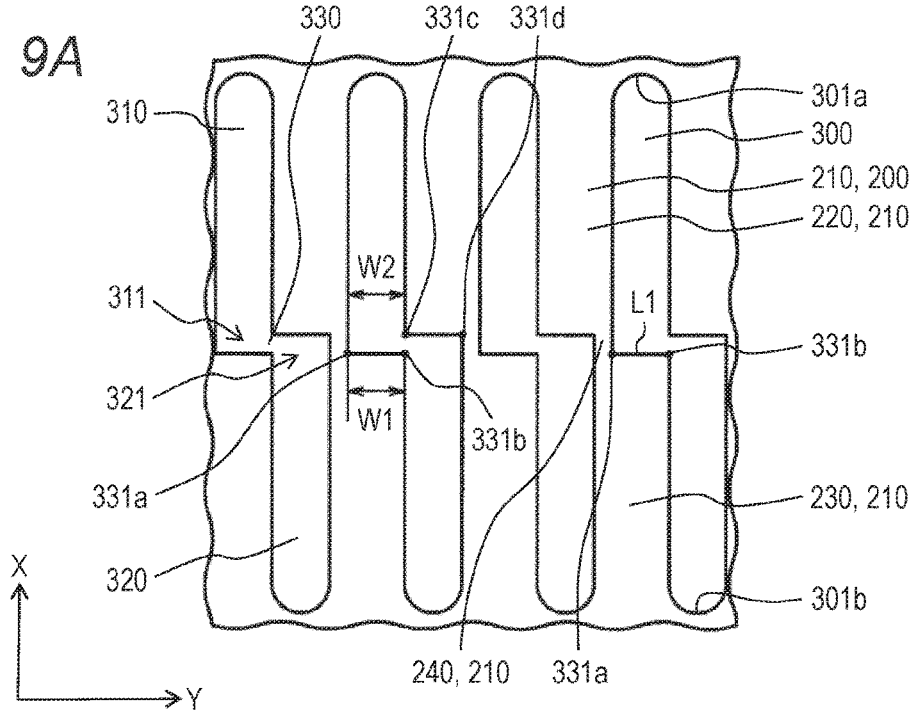
FIG. 9A is an enlarged plan view of slits in a state where a slit outer blade according to a third modification of the exemplary embodiment of the present disclosure is developed.

Each slit 300 shown in FIG. 9A also has a shape where both ends 301*a*, 301*b* of slit 300 in longitudinal direction (the width direction of the outer blade: the length direction of the slit) X are displaced from each other in lateral direction (the length direction of the outer blade: the width direction of the slit) Y.

That is, slit 300 shown in FIG. 9A also has a shape where first slit portion 310 and second slit portion 320 which is disposed at a position displaced from first slit portion 310 in lateral direction (the length direction of the outer blade: the width direction of the slit) Y are connected to each other by connecting slit portion 330.

Displacement width W1 between first slit portion 310 and second slit portion 320 in lateral direction (the length direction of the outer blade: the width direction of the slit) Y is set equal to or larger than width W2 of connecting portion 311, 321 (at least one of the connecting portion of first slit portion 310 and the connecting portion of second slit portion 320) connected to connecting slit portion 330.

To be more specific, connecting slit portion 330 is formed such that displacement width W1 in lateral direction Y of a line segment which connects connecting portion 331*a* to connecting portion 331*b* becomes equal to or larger than width W2 in lateral direction Y of the line segment which connects connecting portion 331*a* to connecting portion 331*c*. In FIG. 9A, connecting slit portion 330 is formed such that displacement width W1 and width W2 are equal to each other (W1=W2).

Connecting slit portion 330 is formed such that an angle made by connecting slit portion 330 and lateral direction (the length direction of the outer blade: the width direction of the slit) Y is set to a value which falls within a range from 0° to 45° inclusive.

That is, angle θ1 made by straight line L1 which connects connecting portion 331*a* to connecting portion 331*b* and lateral direction (the length direction of the outer blade: the width direction of the slit) Y is set to a value which falls within a range from 0° to 45° inclusive. In FIG. 9A, angle θ1 is set to 0°.

That is, connecting crosspiece portion 240 extends in lateral direction (the length direction of the outer blade: the width direction of the slit) Y.

Figure 9B:
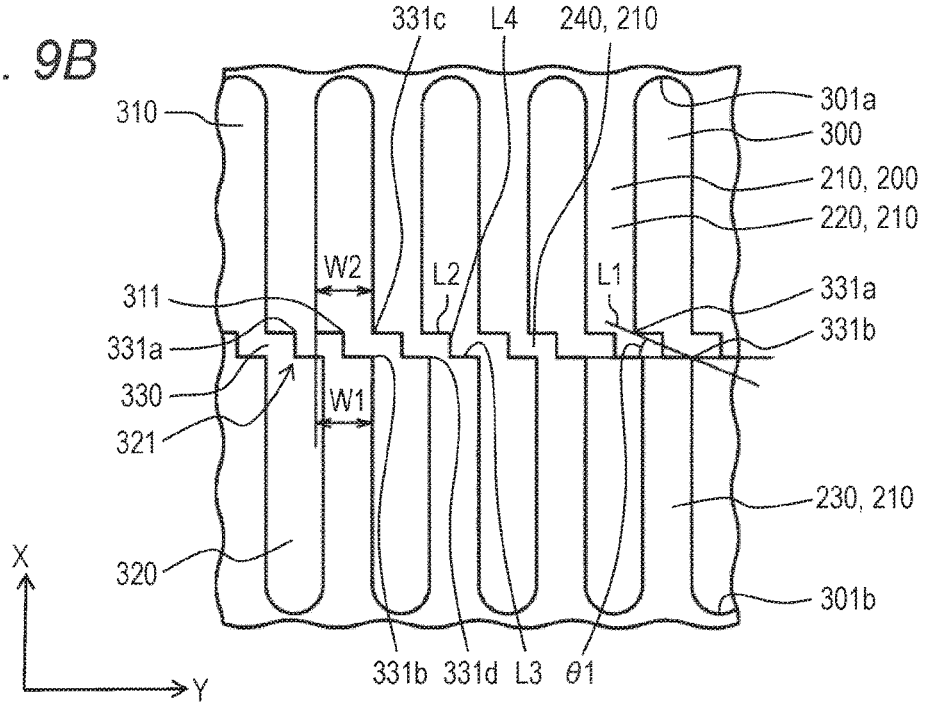
FIG. 9B is an enlarged plan view of slits in a state where a slit outer blade according to a fourth modification of the exemplary embodiment of the present disclosure is developed.

Each slit 300 shown in FIG. 9B also has a shape where both ends 301*a*, 301*b* of slit 300 in longitudinal direction (the width direction of the outer blade: the length direction of the slit) X are displaced from each other in lateral direction (the length direction of the outer blade: the width direction of the slit) Y.

That is, slit 300 shown in FIG. 9B also has a shape where first slit portion 310 and second slit portion 320 which is disposed at a position displaced from first slit portion 310 in lateral direction (the length direction of the outer blade: the width direction of the slit) Y are connected to each other by connecting slit portion 330.

Displacement width W1 between first slit portion 310 and second slit portion 320 in lateral direction (the length direction of the outer blade: the width direction of the slit) Y is set equal to or larger than width W2 of connecting portion 311, 321 (at least one of the connecting portion of first slit portion 310 and the connecting portion of second slit portion 320) connected to connecting slit portion 330.

To be more specific, connecting slit portion 330 is formed such that displacement width W1 in lateral direction Y of a line segment which connects connecting portion 331*a* to connecting portion 331*b* becomes equal to or larger than width W2 in lateral direction Y of the line segment which connects connecting portion 331*a* to connecting portion 331*c*. In FIG. 9B, connecting slit portion 330 is formed such that displacement width W1 and width W2 are equal to each other (W1=W2).

Connecting slit portion 330 is formed such that an angle made by connecting slit portion 330 and lateral direction (the length direction of the outer blade: the width direction of the slit) Y is set to a value which falls within a range from 0° to 45° inclusive.

That is, angle θ1 made by straight line L1 which connects connecting portion 331*a* to connecting portion 331*b* and lateral direction (the length direction of the outer blade: the width direction of the slit) Y is set to a value which falls within a range from 0° to 45° inclusive.

Further, in FIG. 9B, connecting crosspiece portion 240 of crosspiece 210 is formed into a stepped shape. To be more specific, in FIG. 9B, connecting crosspiece portion 240 is formed into a stepped shape where end portions of straight lines L2, L3 extending in lateral direction (the length direction of the outer blade: the width direction of the slit) Y are connected to each other by straight line L4 extending in longitudinal direction (the width direction of the outer blade: the length direction of the slit) X.

Figure 9C:
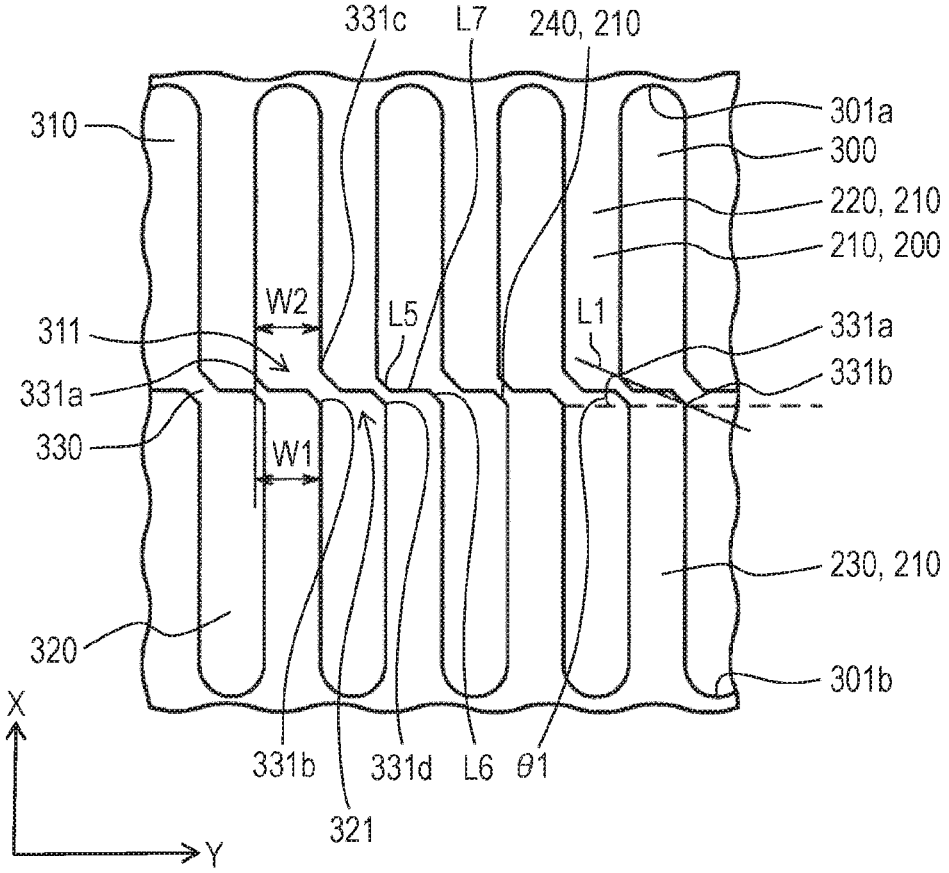
FIG. 9C is an enlarged plan view of slits in a state where a slit outer blade according to a fifth modification of the exemplary embodiment of the present disclosure is developed.

Each slit 300 shown in FIG. 9C also has a shape where both ends 301*a*, 301*b* of slit 300 in longitudinal direction (the width direction of the outer blade: the length direction of the slit) X are displaced from each other in lateral direction (the length direction of the outer blade: the width direction of the slit) Y.

That is, slit 300 shown in FIG. 9C also has a shape where first slit portion 310 and second slit portion 320 which is disposed at a position displaced from first slit portion 310 in lateral direction (the length direction of the outer blade: the width direction of the slit) Y are connected to each other by connecting slit portion 330.

Displacement width W1 between first slit portion 310 and second slit portion 320 in lateral direction (the length direction of the outer blade: the width direction of the slit) Y is set equal to or larger than width W2 of connecting portion 311, 321 (at least one of the connecting portion of first slit portion 310 and the connecting portion of second slit portion 320) connected to connecting slit portion 330.

To be more specific, connecting slit portion 330 is formed such that displacement width W1 in lateral direction Y of a line segment which connects connecting portion 331*a* to connecting portion 331*b* becomes equal to or larger than width W2 in lateral direction Y of the line segment which connects connecting portion 331*a* to connecting portion 331*c*. In FIG. 9C, connecting slit portion 330 is formed such that displacement width W1 and width W2 are equal to each other (W1=W2).

Connecting slit portion 330 is formed such that an angle made by connecting slit portion 330 and lateral direction (the length direction of the outer blade: the width direction of the slit) Y is set to a value which falls within a range from 0° to 45° inclusive.

That is, angle θ1 made by straight line L1 which connects connecting portion 331*a* to connecting portion 331*b* and lateral direction (the length direction of the outer blade: the width direction of the slit) Y is set to a value which falls within a range from 0° to 45° inclusive.

Also in FIG. 9C, connecting crosspiece portion 240 is formed into a stepped shape. To be more specific, in FIG. 9C, connecting crosspiece portion 240 is formed into a shape where end portions of straight lines L5, L6 extending in the oblique direction (the direction which intersects with lateral direction Y and longitudinal direction X) are connected to each other by straight line L7 extending in lateral direction (the length direction of the outer blade: the width direction of the slit) Y.

In FIG. 9B and FIG. 9C, slit outer blade 60 is exemplified where each slit 300 is formed such that displacement width W1 and width W2 are equal to each other (W1=W2), and connecting crosspiece portion 240 of each crosspiece 210 is formed into a stepped shape. However, slit outer blade 60 may be formed such that each slit 300 is formed such that displacement width W1 is larger than width W2 (W1>W2), and connecting crosspiece portion 240 of crosspiece 210 is formed into a stepped shape.

Slit outer blade 60 which forms one of outer blades 20 may be formed to have a larger hair lifting force. Hereinafter, the configuration of slit outer blade 60 which can increase a hair lifting force is described.

Figure 10A:
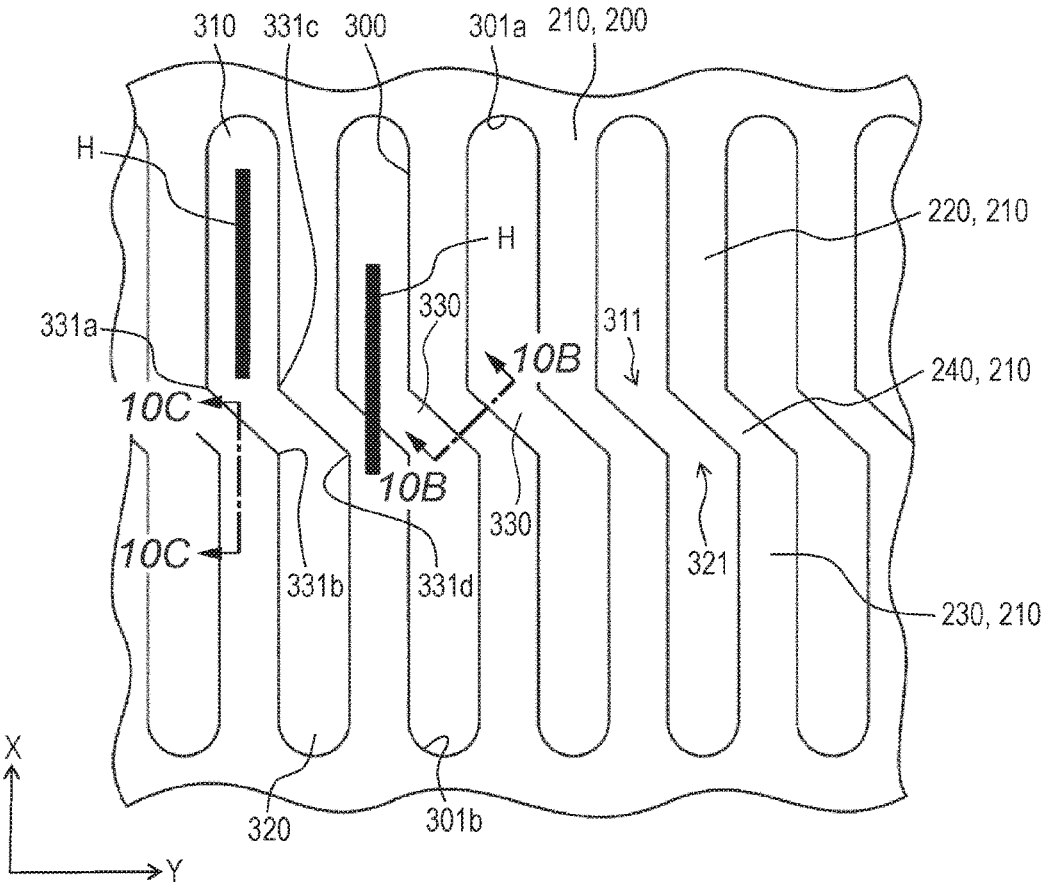
FIG. 10A is an enlarged plan view of slits in a state where a slit outer blade according to a sixth modification of the exemplary embodiment of the present disclosure is developed.
Figure 10B:
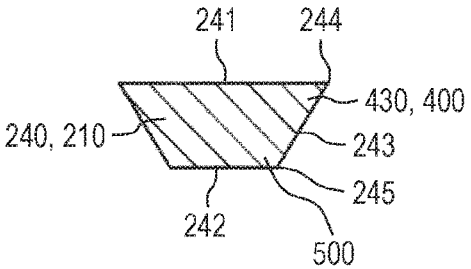
FIG. 10B is a cross-sectional view taken along line 10B-10B in FIG. 10A.
Figure 10C:
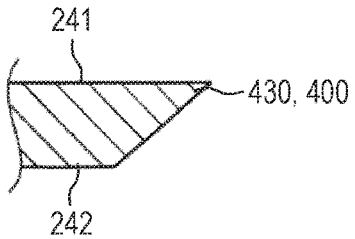
FIG. 10C is a cross-sectional view taken along line 10C-10C in FIG. 10A.

First, as shown in FIG. 10A to FIG. 10C, first hair lifting portions 400 may be formed on edge portions on the skin contact surface (outer surface) 241 side of connecting crosspiece portion 240 of each crosspiece 210 (outer blade body 200).

As shown in FIG. 10B which is a cross-sectional view taken along line 10B-10B in FIG. 10A, a cross-sectional shape of connecting crosspiece portion 240 (a cross-sectional shape taken along a plane parallel to the vertical direction Z and orthogonal to the extending direction of connecting crosspiece portion 240) is formed into an approximately trapezoidal shape. That is, connecting crosspiece portion 240 is defined by: substantially flat skin contact surface (outer surface) 241 which is brought into contact with skin (skin surface) S; substantially flat inner surface 242 which faces slit inner blade 90 below skin contact surface (outer surface) 241 (on the side opposite to the outer surface); and side surfaces 243 which connect skin contact surface (outer surface) 241 to inner surface 242. In this exemplary embodiment, skin contact surface (outer surface) 241 has a larger width than inner surface 242 so that both ends of skin contact surface (outer surface) 241 project more to the connecting slit portion 330 side than both ends of inner surface 242. Accordingly, side surfaces 243 form inclined surfaces which are inclined upward and outward (toward the side of facing connecting crosspiece portion 240).

Acute-angled edge portions (distal end portions) of skin contact surface side end portions 244 of connecting crosspiece portion 240 form first hair lifting portions 400. As described above, in FIG. 10B, each first hair lifting portion 400 includes acute-angled portion 430 where an angle made by skin contact surface (outer surface) 241 of connecting crosspiece portion 240 and whole (a part of or whole) side surface 243 of connecting crosspiece portion 240 is an acute angle.

On the other hand, an angle made by inner surface 242 of connecting crosspiece portion 240 and whole (a part of or whole) side surface 243 of connecting crosspiece portion 240 is set to 90° or more.

That is, when connecting crosspiece portion 240 is viewed in a cross-sectional view taken along a plane parallel to vertical direction Z and orthogonal to the extending direction of connecting crosspiece portion 240, an angle of each inner surface side end portion 245 is set to 90° or more.

As described above, in FIG. 10B, inner surface side end portions 245 of connecting crosspiece portion 240 form obtuse angled edge portions (corner portions), that is, form obtuse-angled portions 500.

It is sufficient for first hair lifting portion 400 to be formed on at least a portion of each connecting crosspiece portion 240. However, to allow slit outer blade 60 to exhibit a hair lifting force more uniformly, it is preferable to form first hair lifting portion 400 on whole connecting crosspiece portion 240.

Figure 11:
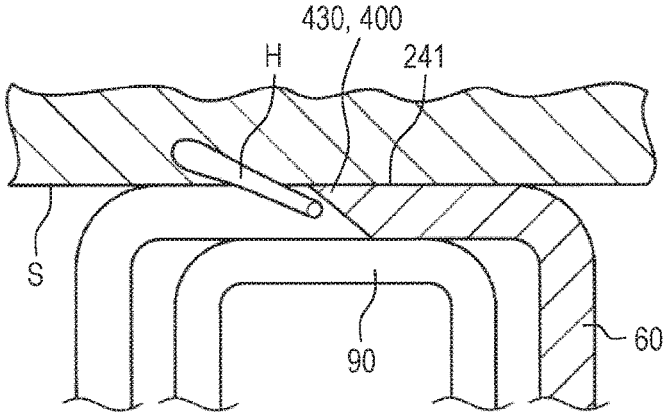
FIG. 11 is a cross-sectional view schematically showing a state where a first hair lifting portion of the slit outer blade according to the sixth modification of the exemplary embodiment of the present disclosure lifts body hair lying flat against the skin.

As described above, in slit outer blade 60, connecting crosspiece portion 240 extending in the direction which intersects with longitudinal direction (the width direction of the outer blade: the length direction of the slit) X includes first hair lifting portions 400 having acute-angled portion 430. With such a configuration, when slit outer blade 60 is moved in longitudinal direction (the width direction of the outer blade: the length direction of the slit) X, as shown in FIG. 10C and FIG. 11, an apparent angle of each acute-angled portion 430 (first hair lifting portion 400) becomes small. Accordingly, slit outer blade 60 can exhibit a larger hair lifting force.

Figure 12:
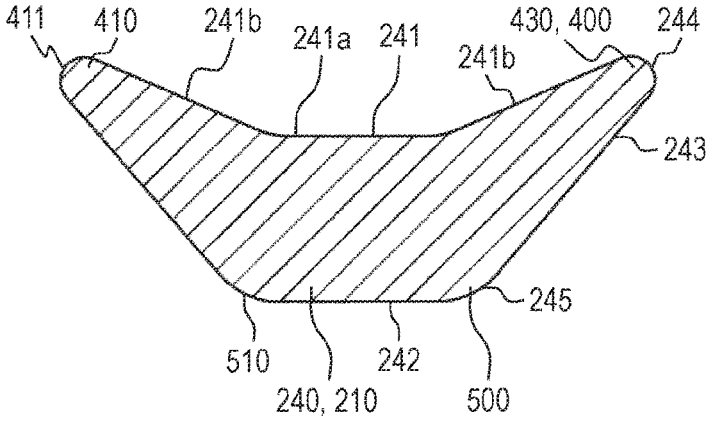
FIG. 12 is a cross-sectional view of a connecting crosspiece portion of a slit outer blade according to a seventh modification of the exemplary embodiment of the present disclosure.

As shown in FIG. 12, a cross-sectional shape of connecting crosspiece portion 240 (a cross-sectional shape taken along a plane parallel to the vertical direction Z and orthogonal to the extending direction of connecting crosspiece portion 240) may be formed into a shape where first hair lifting portions 400 having acute-angled portion 430 are bent upwardly. That is, when connecting crosspiece portion 240 is viewed in a cross-sectional view taken along a plane parallel to vertical direction Z and orthogonal to the extending direction of connecting crosspiece portion 240, skin contact surface (outer surface) 241 of connecting crosspiece portion 240 may have: horizontal surface 241*a* which is positioned at the center of skin contact surface 241 and extends substantially in the horizontal direction; and inclined surfaces 241*b* which are respectively connected to both ends of horizontal surface 241*a* and are inclined upward and outward (toward the side of facing connecting crosspiece portion 240).

In this case, it is preferable to form first rounded portion 411 on distal end 410 of each first hair lifting portion 400 so as to suppress an effect on skin S. Each obtuse-angled portion (an edge portion of connecting crosspiece portion 240 on inner surface 242 side) 500 formed on inner surface side end portion 245 of connecting crosspiece portion 240 may have third rounded portion 510 where a corner is rounded.

Figure 13:
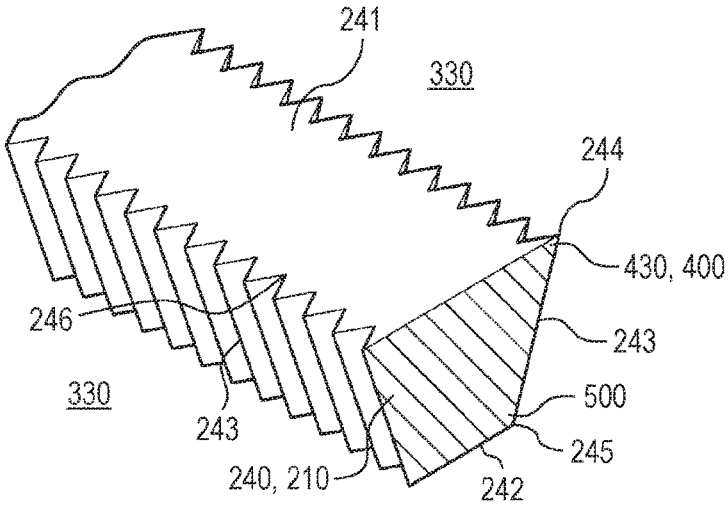
FIG. 13 is a perspective view showing a connecting crosspiece portion of a slit outer blade according to an eighth modification of the exemplary embodiment of the present disclosure.

As shown in FIG. 13, on side surfaces (at least on side surfaces of portions of crosspiece 210 where first hair lifting portions 400 are formed) 243 of connecting crosspiece portion 240, groove portions 246 which extend from the skin contact surface (outer surface) 241 side to the inner surface 242 side may be formed.

In FIG. 13, the plurality of groove portions 246 are arranged in the extending direction of connecting crosspiece portion 240. As described above, by forming groove portions 246 extending in the vertical direction on each side surface 243, resistance against movement of body hair H which is brought into contact with side surface 243 in the vertical direction can be made smaller than resistance against movement of body hair H which is brought into contact with side surface 243 in the extending direction of connecting crosspiece portion 240. As a result, body hair H can be easily moved along groove portions 246 so that body hair H lying flat against skin S can be lifted with more certainty.

Figure 14A:
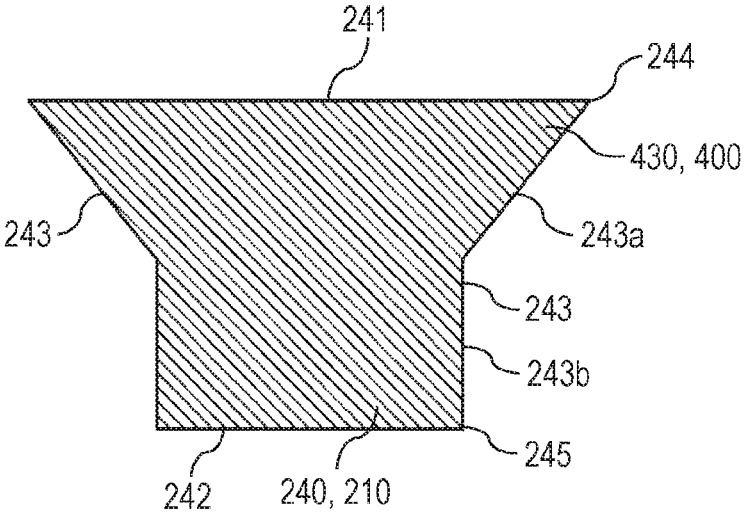
FIG. 14A is a cross-sectional view showing a connecting crosspiece portion of a slit outer blade according to a ninth modification of the exemplary embodiment of the present disclosure.

By forming a cross-sectional shape of connecting crosspiece portion 240 (a cross-sectional shape taken along a plane parallel to the vertical direction Z and orthogonal to the extending direction of connecting crosspiece portion 240) into a shape shown in FIG. 14A, first hair lifting portions 400 may be formed on edge portions on the skin contact surface (outer surface) 241 side of connecting crosspiece portion 240.

To be more specific, connecting crosspiece portion 240 is defined by: substantially flat skin contact surface (outer surface) 241 which is brought into contact with skin (skin surface) S; substantially flat inner surface 242 which faces slit inner blade 90 below skin contact surface (outer surface) 241 (on the side opposite to the outer surface); and side surfaces 243 which connect skin contact surface (outer surface) 241 to inner surface 242. In FIG. 14A, each side surface 243 includes: vertical surface 243*b* positioned on the lower side of side surface 243 (on the side opposite to outer surface) and extending in vertical direction Z; and inclined surface 243*a* formed continuously with an upper end of vertical surface 243*b* and inclined upward and outward (toward the side of facing connecting crosspiece portion 240).

As described above, in FIG. 14A, a cross-sectional shape of connecting crosspiece portion 240 (a cross-sectional shape taken along a plane parallel to the vertical direction Z and orthogonal to the extending direction of connecting crosspiece portion 240) is formed into a polygonal cross-sectional shape where a lower portion of an approximately rectangular shape is connected to an upper portion of an approximately trapezoidal shape such that skin contact surface (outer surface) 241 has a larger width than inner surface 242.

By forming connecting crosspiece portion 240 into such a shape, in FIG. 14A, acute-angled portions (edge portions: distal end portions) 430 formed on skin contact surface side end portions 244 form first hair lifting portions 400.

In this exemplary embodiment, a lower portion of connecting crosspiece portion 240 has an approximately rectangular shape so that inner surface side end portions 245 of connecting crosspiece portion 240 form edge portions (corner portions) having substantially a right angle.

That is, in FIG. 14A, an angle made by inner surface 242 of connecting crosspiece portion 240 and a part of (a part of or whole) side surface 243 of connecting crosspiece portion 240 is set to 90° (90° or more).

As described above, also when connecting crosspiece portion 240 is formed into a shape shown in FIG. 14A, first hair lifting portions 400 can project more outward than inner surface side end portions 245 and hence, a hair lifting force of slit outer blade 60 (a hair lifting force of connecting crosspiece portion 240) can be further increased.

As shown in FIG. 14A, by setting an angle of inner surface side end portions 245 of connecting crosspiece portion 240 to 90° or more, it is possible to prevent inner surface side end portions 245 from projecting outward. Accordingly, it is possible to suppress that body hair H impinges on inner surface side end portion 245. As a result, it is possible to suppress the occurrence of a phenomenon where the introduction of body hair H into an area closer to the slit inner blade 90 side than the sliding surfaces (inner surface 200*b* and outer surface 90*a* (see FIG. 5)) is obstructed by inner surface side end portion 245. Accordingly, body hair H can be smoothly introduced into an area closer to the slit inner blade 90 side than the sliding surfaces (inner surface 200*b* and outer surface 90*a*) and hence, body hair H can be shaved more efficiently.

It is sufficient for first hair lifting portion 400 shown in FIG. 14A to be formed on at least a portion of each connecting crosspiece portion 240. However, to allow slit outer blade 60 to exhibit a hair lifting force more uniformly, it is preferable to form first hair lifting portion 400 on whole connecting crosspiece portion 240.

Figure 14B:
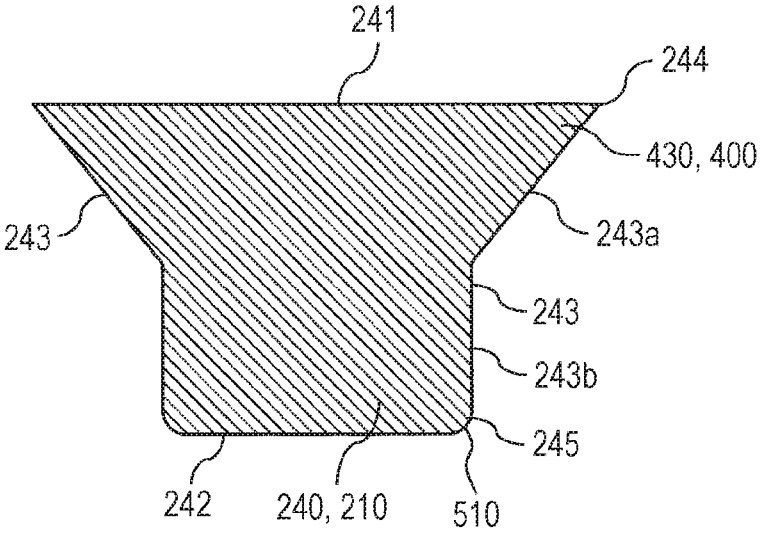
FIG. 14B is a cross-sectional view showing a connecting crosspiece portion of the slit outer blade according to a tenth modification of the exemplary embodiment of the present disclosure.

As shown in FIG. 14B, third rounded portion 510 may be formed on inner surface side end portions 245 of connecting crosspiece portion 240 which is formed into a shape shown in FIG. 14A. It is preferable that radius of curvature of third rounded portion 510 be set equal to or less than 20 μm.

In this exemplary embodiment, connecting crosspiece portion 240 shown in any one of the above-mentioned respective drawings may be formed such that inner surface 242 can be brought into slide contact with outer surface 90*a* of slit inner blade 90. For example, connecting crosspiece portion 240 may be formed into a cross-sectional shape shown in FIG. 14A, and inner surface 242 of connecting crosspiece portion 240 may be brought into slide contact with outer surface 90*a* of slit inner blade 90.

In this exemplary embodiment, connecting crosspiece portion 240 extends in the direction which intersects with longitudinal direction (the width direction of the outer blade: the length direction of the slit) X so that connecting crosspiece portion 240 forms a portion having a large shear angle at the time of shearing body hair H by slit inner blade 90 and slit outer blade 60.

The shear angle is, as viewed from the skin contact surface 200*a* side (as viewed in vertical direction Z), an intersecting angle between a ridge line of slit outer blade 60 on the sliding surface (inner surface 200*b* and outer surface 90*a*) (a line which inner surface side end portion 225 draws, a line which inner surface side end portion 245 or the like draws) and a ridge line of slit inner blade 90 (a boundary line of both ends of outer surface 90*a* in lateral direction Y) (see FIG. 5).

Particularly, in the above-mentioned slit 300, angle θ1 made by straight line L1 which connects connecting portion 331*a* to connecting portion 331*b* and lateral direction (the length direction of the outer blade: the width direction of the slit) Y is set to a value which falls within a range from 0° to 45° inclusive.

Accordingly, connecting crosspiece portion 240 has a large shear angle at the time of shearing body hair H by slit inner blade 90 and slit outer blade 60 (when a ridge line of slit inner blade 90 is parallel to longitudinal direction X, the shear angle is set to a value which falls within a range from 45° to 90° inclusive).

Accordingly, connecting crosspiece portion 240 is a portion where a cutting failure such as half cut is liable to occur. Half cut is a failure where body hair H is not completely cut and is brought into a half cut state.

However, as shown in FIG. 14B, by forming third rounded portion 510 where a corner is rounded on inner surface side end portions 245 of connecting crosspiece portion 240, cutting of body hair H at connecting crosspiece portion 240 can be suppressed.

With such a configuration, while preventing cutting of body hair H at connecting crosspiece portion 240 where a cutting failure such as half cut is liable to occur, body hair H can be shorn by slit inner blade 90 and slit outer blade 60 (first crosspiece portion 220 or second crosspiece portion 230) when body hair H is moved to first slit portion 310 or second slit portion 320.

As described above, by forming third rounded portion 510 where a corner is rounded on inner surface side end portions 245 of connecting crosspiece portion 240, a cutting failure such as half cut which occurs at the time of cutting body hair H can be suppressed and hence, body hair H can be shaved with more certainty.

Also when connecting crosspiece portion 240 shown in FIG. 12 is adopted, substantially the same advantageous effects can be acquired.

Figure 15:
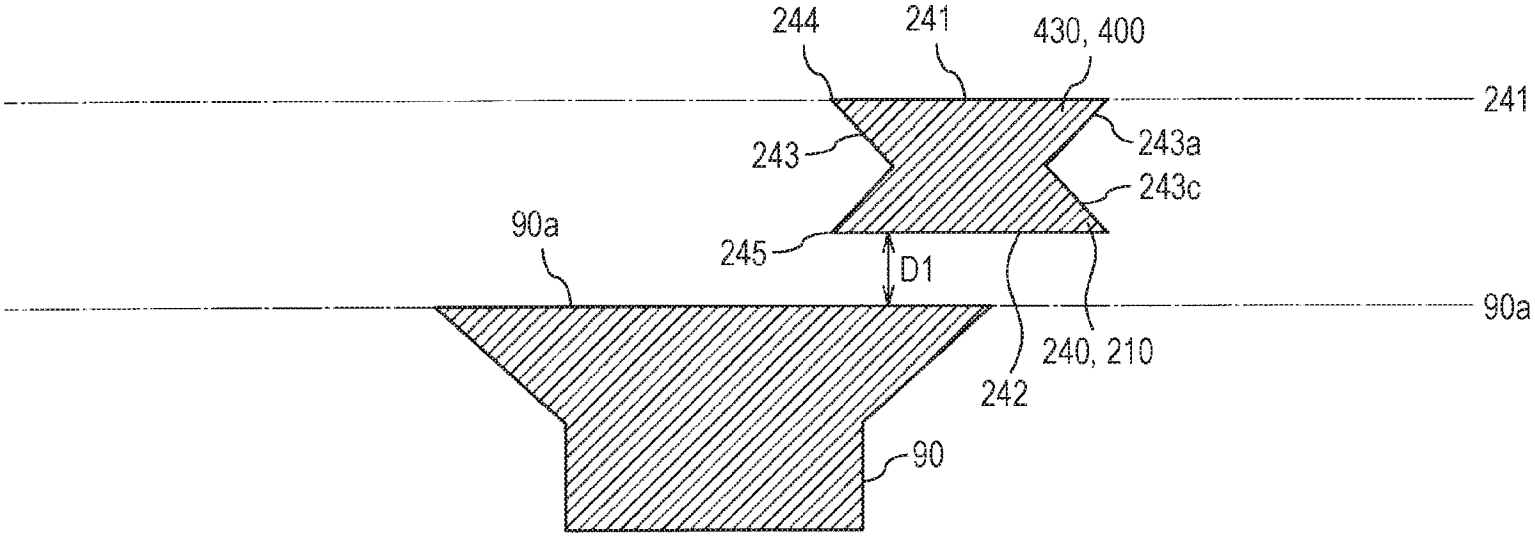
FIG. 15 is a cross-sectional view schematically showing a positional relationship between a slit outer blade according to an eleventh modification of the exemplary embodiment of the present disclosure and a slit inner blade of a connecting crosspiece portion.

As shown in FIG. 15, a cross-sectional shape of connecting crosspiece portion 240 (a cross-sectional shape taken along a plane parallel to the vertical direction Z and orthogonal to the extending direction of connecting crosspiece portion 240) may be formed into a shape where an angle of inner surface side end portions 245 of connecting crosspiece portion 240 is an acute angle.

To be more specific, connecting crosspiece portion 240 is defined by: substantially flat skin contact surface (outer surface) 241 which is brought into contact with skin (skin surface) S; substantially flat inner surface 242 which faces slit inner blade 90 below skin contact surface (outer surface) 241 (on the side opposite to the outer surface); and side surfaces 243 which connect skin contact surface (outer surface) 241 to inner surface 242. In FIG. 15, each side surface 243 includes: inclined surface 243*c* positioned on the lower side of side surface 243 (on the side opposite to outer surface) and inclined downward and outward (toward the side of facing connecting crosspiece portion 240); and inclined surface 243*a* formed continuously with an upper end of inclined surface 243*c* and inclined upward and outward (toward the side of facing connecting crosspiece portion 240).

As described above, in FIG. 15, a cross-sectional shape of connecting crosspiece portion 240 (a cross-sectional shape taken along a plane parallel to the vertical direction Z and orthogonal to the extending direction of connecting crosspiece portion 240) is formed into a polygonal shape where a lower portion of an approximately trapezoidal shape is connected to an upper portion of an approximately trapezoidal shape. That is, in FIG. 15, connecting crosspiece portion 240 has a cross-sectional shape where an upper end and a lower end of connecting crosspiece portion 240 project more outward than a center portion of connecting crosspiece portion 240.

By forming connecting crosspiece portion 240 into such a shape, in FIG. 15, acute-angled portions (edge portions: distal end portions) 430 formed on skin contact surface side end portion 244 form first hair lifting portions 400.

In this exemplary embodiment, inner surface side end portions 245 of connecting crosspiece portion 240 form acute angled edge portions (corner portions).

As described above, connecting crosspiece portion 240 is a portion where a cutting failure such as half cut is liable to occur. Accordingly, it is preferable to suppress a cutting failure such as half cut which occurs at the time of cutting body hair H.

In view of the above, in FIG. 15, gap D1 is formed between inner surface 242 of connecting crosspiece portion 240 and outer surface 90*a* of slit inner blade 90.

By forming gap D1 between inner surface 242 and outer surface 90*a* of slit inner blade 90 in this manner, it is possible to prevent inner surface 242 of connecting crosspiece portion 240 from being brought into contact with outer surface 90*a*. With such a configuration, body hair H is not cut by connecting crosspiece portion 240 which includes a region where first hair lifting portions 400 are formed. Gap D1 is preferably set to a value equal to or more than 100 μm.

As described above, by forming gap D1 between inner surface 242 of connecting crosspiece portion 240 and slit inner blade 90, cutting of body hair H at connecting crosspiece portion 240 where a cutting failure such as half cut is liable to occur can be suppressed with more certainty. As a result, a cutting failure such as half cut which occurs at the time of cutting body hair H can be suppressed with more certainty.

Connecting crosspiece portion 240 may be formed into a cross-sectional shape shown in any one of the above-mentioned respective drawings, and gap D1 may be formed between inner surface 242 of connecting crosspiece portion 240 and outer surface 90*a* of slit inner blade 90.

As viewed from a side where slit outer blade 60 is brought into contact with skin (skin surface) S, it is preferable that first hair lifting portion 400 be disposed at a position where first hair lifting portion 400 overlaps with slit inner blade 90. That is, as shown in FIG. 17A to FIG. 17C, as viewed in lateral direction (the length direction of the outer blade: the width direction of the slit) Y, it is preferable to dispose first hair lifting portion 400 such that first hair lifting portion 400 and slit inner blade 90 are made to overlap with each other in vertical direction Z.

Figure 16A:
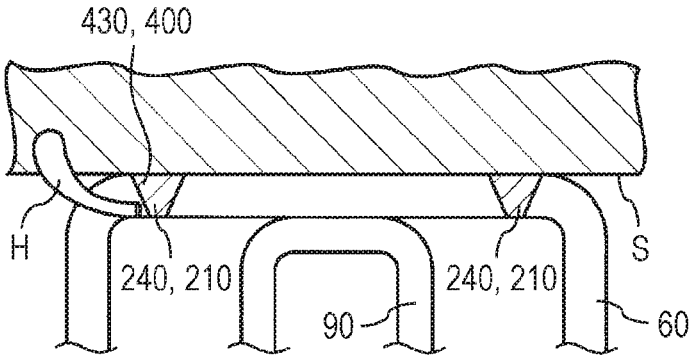
FIG. 16A is a cross-sectional view showing a state where body hair is introduced into a slit when the body hair is shaved using a slit outer blade according to a comparative example.
Figure 16B:
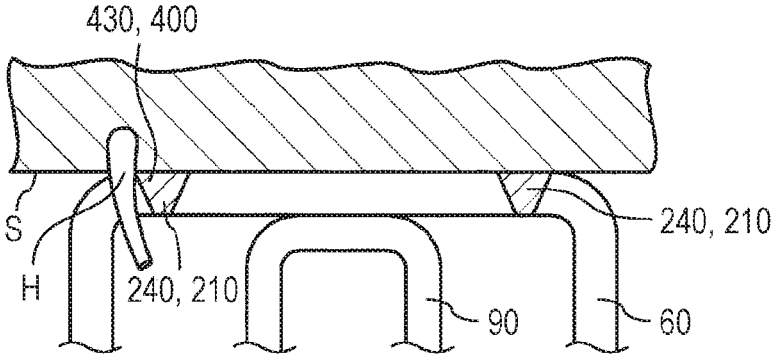
FIG. 16B is a cross-sectional view showing a state where body hair is lifted when the body hair is shaved using the slit outer blade according to the comparative example.
Figure 16C:
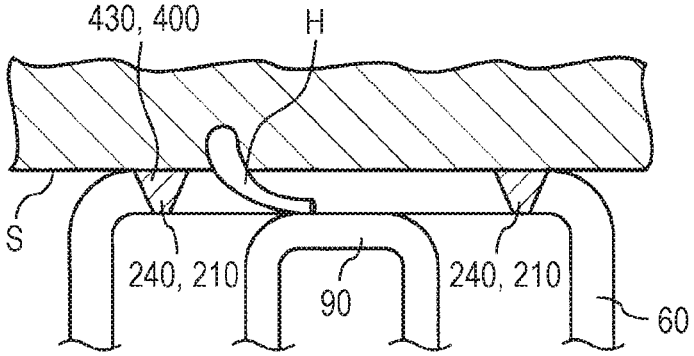
FIG. 16C is a cross-sectional view showing a state where body hair is positioned above an inner blade when the body hair is shaved using the slit outer blade according to the comparative example.

For example, as shown in FIG. 16A to FIG. 16C, when first hair lifting portion 400 is disposed at a position where first hair lifting portion 400 and slit inner blade 90 are not made to overlap with each other in vertical direction Z as viewed in lateral direction (the length direction of the outer blade: the width direction of the slit) Y, there is a possibility that body hair H lifted by first hair lifting portion 400 is laid down again before body hair H reaches a region where body hair H can be cut by slit inner blade 90.

Figure 17A:
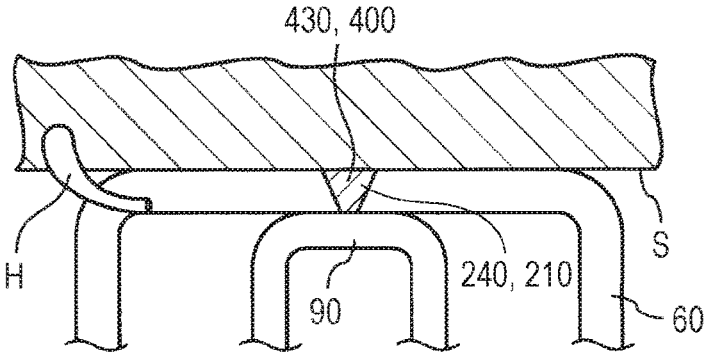
FIG. 17A is a cross-sectional view showing a state where body hair is introduced into a slit when the body hair is shaved using the slit outer blade according to the exemplary embodiment of the present disclosure.
Figure 17B:
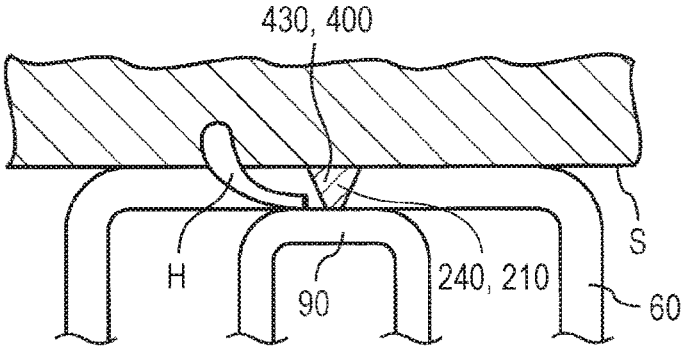
FIG. 17B is a cross-sectional view showing a state where body hair is positioned above an inner blade when the body hair is shaved using the slit outer blade according to the exemplary embodiment of the present disclosure.
Figure 17C:
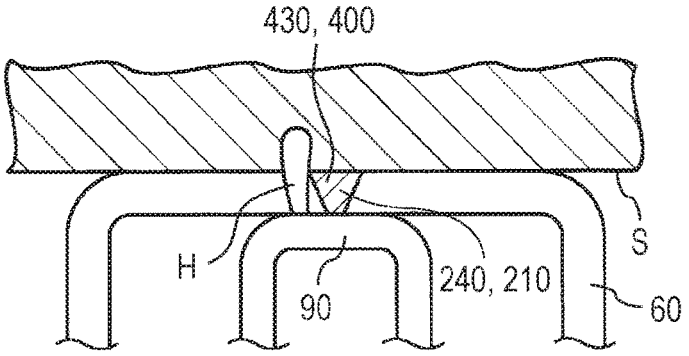
FIG. 17C is a cross-sectional view showing a state where lifted body hair is cut when the body hair is shaved using the slit outer blade according to the exemplary embodiment of the present disclosure.

On the other hand, as shown in FIG. 17A to FIG. 17C, by forming first hair lifting portion 400 at a position where first hair lifting portion 400 and slit inner blade 90 are made to overlap with each other in vertical direction Z as viewed in lateral direction (the length direction of the outer blade: the width direction of the slit) Y, body hair H lifted by first hair lifting portion 400 can be cut in a lifted state with more certainty.

Figure 18A:
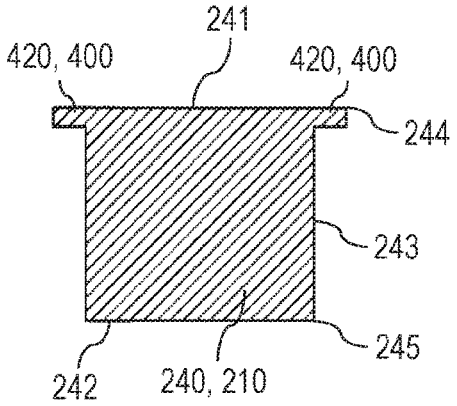
FIG. 18A is a cross-sectional view showing a connecting crosspiece portion of the slit outer blade according to a twelfth modification of the exemplary embodiment of the present disclosure.

As shown in FIG. 18A, each first hair lifting portion 400 may have first projecting portion 420 projecting toward connecting slit portion 330. That is, first projecting portions 420 projecting outward may be formed on the skin contact surface (outer surface) 241 side of connecting crosspiece portion 240, and each first projecting portion 420 may be used as first hair lifting portion 400. In FIG. 18A, first projecting portions 420 are integrally formed with connecting crosspiece portion 240.

Figure 18B:
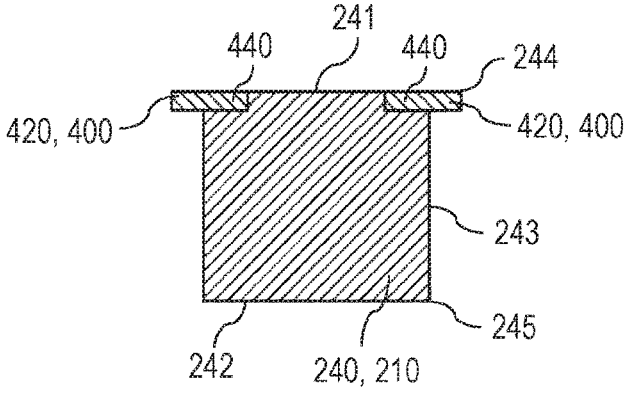
FIG. 18B is a cross-sectional view showing a connecting crosspiece portion of a slit outer blade according to a thirteenth modification of the exemplary embodiment of the present disclosure.
Figure 18C:
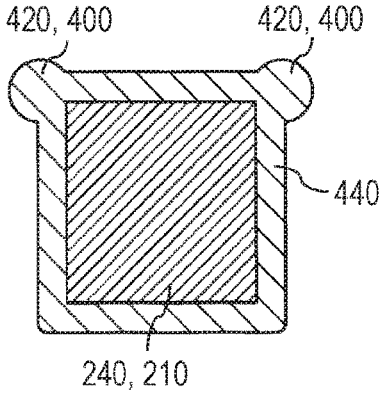
FIG. 18C is a cross-sectional view showing a connecting crosspiece portion of a slit outer blade according to a fourteenth modification of the exemplary embodiment of the present disclosure.

As shown in FIG. 18B and FIG. 18C, first projecting portions 420 may be formed by fixing projecting members 440 which are members separate from connecting crosspiece portion 240 to connecting crosspiece portion 240.

As described above, by adopting the configuration which can increase a hair lifting force of slit outer blade 60, body hair H lying flat against skin S can be lifted with more certainty. However, when a hair lifting force is increased, there is a possibility that skin S is damaged. Accordingly, it is preferable to suppress an effect on skin S while increasing a hair lifting force.

Hereinafter, a configuration which can suppress an effect on skin S is described.

First, as shown in FIG. 18B and FIG. 18C, by using a material such as a resin, rubber or a soft material which can suppress an effect on skin S when the electric shaver is used as a material for forming projecting members 440 which are members separate from connecting crosspiece portion 240, an effect on skin S can be suppressed.

As a method for mounting projecting members 440 which are members separate from connecting crosspiece portions 240 on connecting crosspiece portion 240, a fitting method, a bonding method, a welding method or the like can be named. Further, as shown in FIG. 18C, first projecting portions 420 may be formed also by applying coating of a resin (projecting members 440 which are members separate from connecting crosspiece portions 240) to an outer periphery of connecting crosspiece portion 240.

As described above, by forming first projecting portions 420 using a material which can suppress an effect on skin S when the electric shaver is used, body hair H lying flat against skin S can be lifted with more certainty and stimulus to skin S which is caused by first hair lifting portions 400 can be reduced.

Figure 19A:
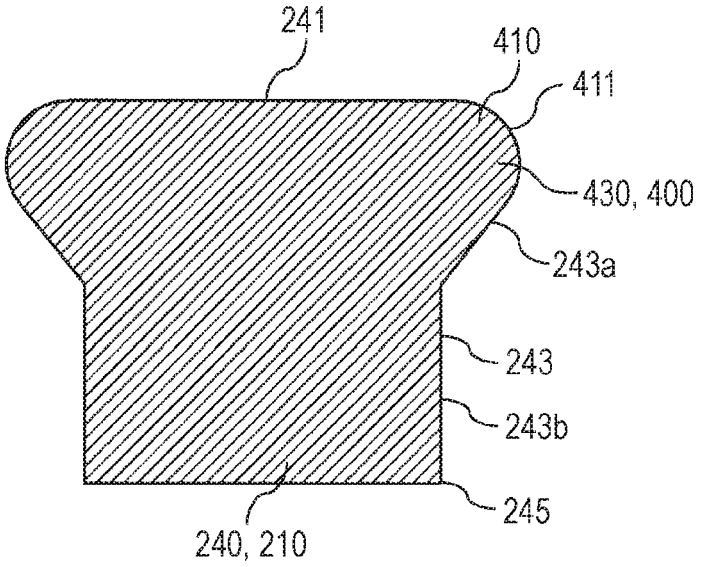
FIG. 19A is a cross-sectional view showing a connecting crosspiece portion of a slit outer blade according to a fifteenth modification of the exemplary embodiment of the present disclosure.
Figure 19B:
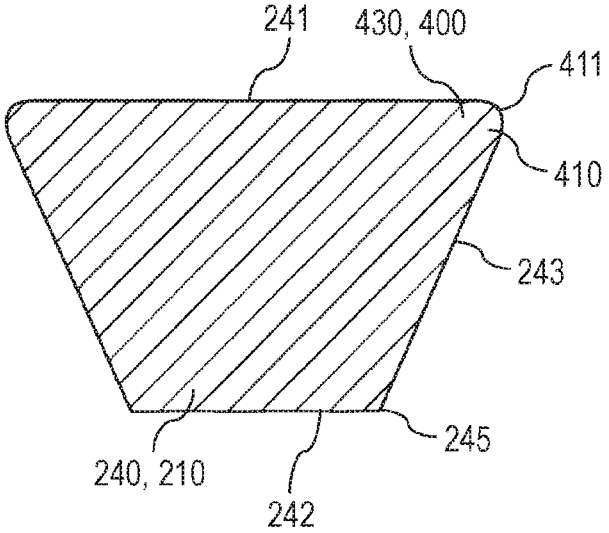
FIG. 19B is a cross-sectional view showing a connecting crosspiece portion of a slit outer blade according to a sixteenth modification of the exemplary embodiment of the present disclosure.

By also forming first rounded portions 411 on edge portions (distal ends 410) of first hair lifting portions 400 as shown in FIG. 19A and FIG. 19B, an effect on skin S can also be suppressed. A radius of curvature of first rounded portion 411 (a radius of curvature of first rounded portion 411 when connecting crosspiece portion 240 is viewed in a cross-sectional view taken along the direction orthogonal to the extending direction of connecting crosspiece portion 240) is preferably set to a value which falls within a range from 20 μm to 60 μm inclusive so as to suppress an effect on skin while allowing first rounded portion 411 to exhibit a hair lifting force.

Figure 20:
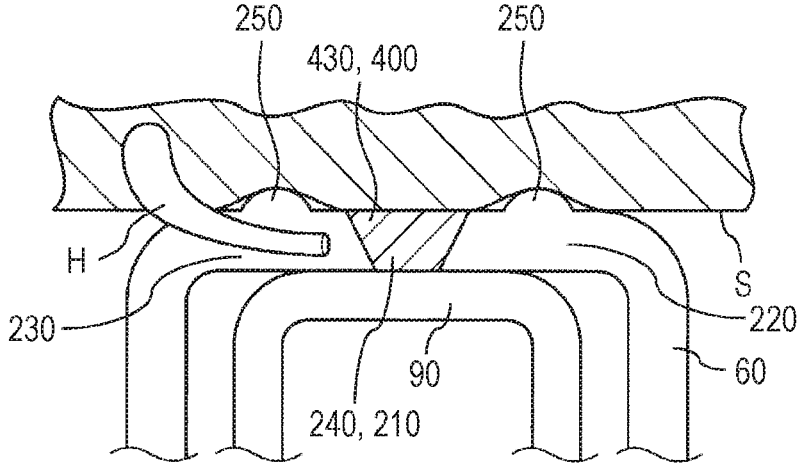
FIG. 20 is a cross-sectional view schematically showing a state where body hair is shaved using a slit outer blade according to a seventeenth modification of the exemplary embodiment of the present disclosure.

As shown in FIG. 20, second projecting portion 250 projecting toward the skin S side may be formed in the vicinity of boundaries (connecting portions 331*a*, 331*b*, 331*c*, 331*d*) (see FIG. 10A) between connecting crosspiece portion 240 (a portion where first hair lifting portions 400 are formed) and first crosspiece portion 220 and second crosspiece portion 230 (portions where first hair lifting portion 400 is not formed). FIG. 20 shows an example where second projecting portion 250 is formed on each of first crosspiece portion 220 and second crosspiece portion 230. However, second projecting portion 250 may be formed on connecting crosspiece portion 240. A projecting amount of second projecting portion 250 from skin contact surface (outer surface) 221, 231 (see FIG. 7B) is preferably set to 30 μm.

With such a configuration, in regions where first hair lifting portions 400 are formed, a contact pressure to skin S can be reduced and hence, stimulus to skin S which is caused by first hair lifting portions 400 can be reduced.

Figure 21A:
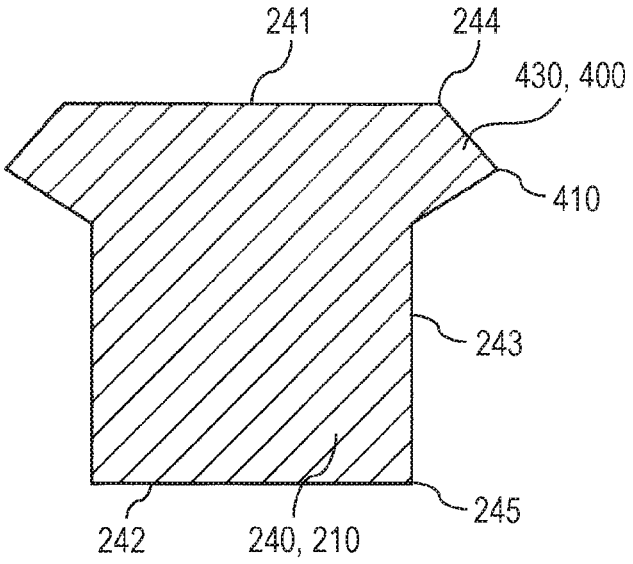
FIG. 21A is a cross-sectional view showing a connecting crosspiece portion of a slit outer blade according to an eighteenth modification of the exemplary embodiment of the present disclosure.

As shown in FIG. 21A, distal ends 410 of first hair lifting portions 400 may be positioned more on the slit inner blade 90 side than skin contact surface (outer surface) 241 is. A distance in vertical direction Z from skin contact surface (outer surface) 241 to distal end 410 of first hair lifting portion 400 is preferably set to 30 μm.

In FIG. 21A, a projecting portion which has: an inclined surface disposed on the upper side (skin S side) of the projecting portion and inclined downward and outward; and an inclined surface disposed on the lower side (inner surface side) of the projecting portion and inclined upward and outward is formed on each of upper portions of both side surfaces 243. A connecting portion between these inclined surfaces forms distal end 410.

Figure 21B:
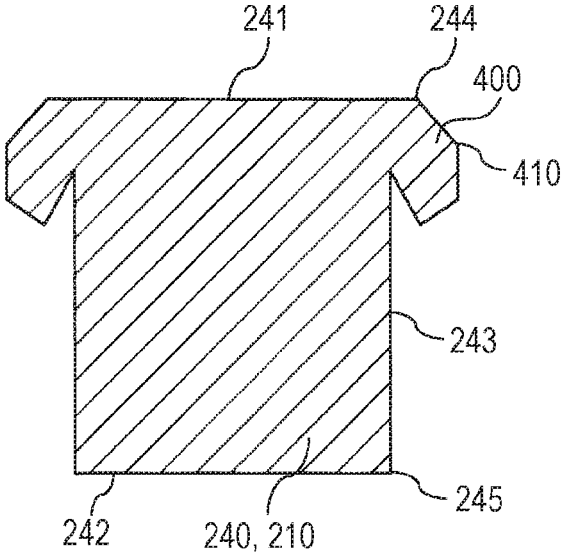
FIG. 21B is a cross-sectional view showing a connecting crosspiece portion of a slit outer blade according to a nineteenth modification of the exemplary embodiment of the present disclosure.

As shown in FIG. 21B, distal ends 410 may be positioned more on the slit inner blade 90 side than skin contact surface (outer surface) 241 is by downwardly deforming portions of distal ends 410 which project outward. Rounded portions may be formed on skin contact surface side end portions 244. A radius of curvature of the rounded portion is preferably set to a value which falls within a range from 20 μm to 60 μm inclusive.

With such a configuration, stimulus to skin S which is caused by first hair lifting portions 400 can be reduced. It may be also possible to adopt the configuration where connecting crosspiece portion 240 is formed into a shape shown in FIG. 21A and rounded portions having a radius of curvature which falls within a range from 20 μm to 60 μm inclusive are formed on skin contact surface side end portions 244.

Figure 22B:
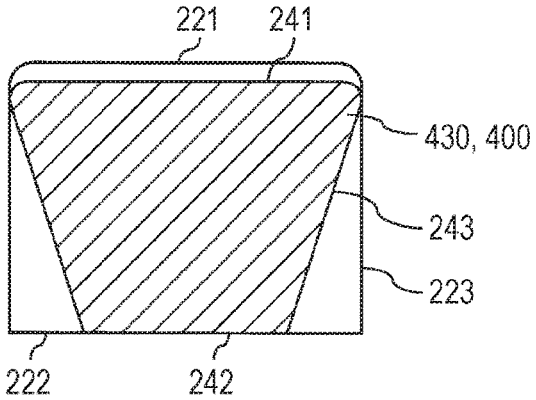
FIG. 22B is a cross-sectional view showing a connecting crosspiece portion of the slit outer blade according to the twentieth modification of the exemplary embodiment of the present disclosure.
Figure 22C:
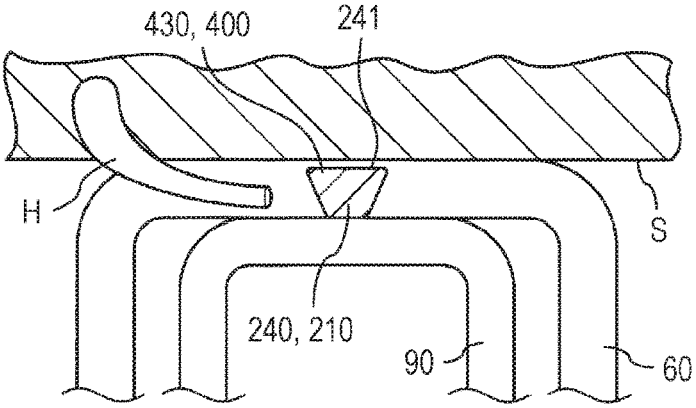
FIG. 22C is a cross-sectional view schematically showing a state where body hair is shaved using the slit outer blade according to the twentieth modification of the exemplary embodiment of the present disclosure.

As shown in FIG. 22A to FIG. 22C, skin contact surface (outer surface) 241 of each connecting crosspiece portion 240 (a portion where first hair lifting portions 400 are formed) may be positioned more on the slit inner blade 90 side than skin contact surfaces (outer surfaces) 221, 231 of first crosspiece portion 220 and second crosspiece portion 230 (portions where first hair lifting portion 400 is not formed) are.

With such a configuration, in regions where first hair lifting portions 400 are formed, a contact pressure to skin S can be reduced and hence, stimulus to skin S which is caused by first hair lifting portions 400 can be reduced.

Figure 23:
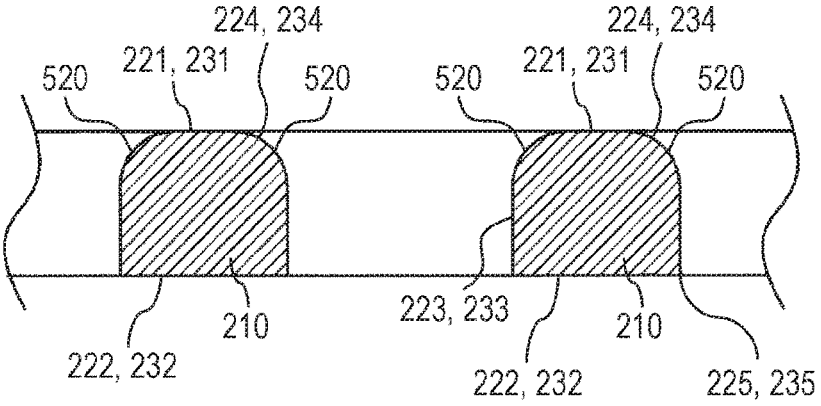
FIG. 23 is a cross-sectional view of a slit outer blade including a first crosspiece portion and a second crosspiece portion according to a twenty first modification of the exemplary embodiment of the present disclosure.

As shown in FIG. 23, edge portions (skin contact surface side end portions 224 and skin contact surface side end portions 234) of skin contact surfaces (outer surfaces) 221, 231 of first crosspiece portion 220 and second crosspiece portion 230 (portions where first hair lifting portion 400 is not formed) may have second rounded portions 520. A radius of curvature of second rounded portion 520 is preferably set equal to or more than 30 μm.

Second rounded portion 520 is preferably formed on substantially the whole region of each skin contact surface side end portion 224, 234 which is brought into contact with skin S. That is, it is preferable to form second rounded portion 520 not only on ceiling wall 61 but also over a range from ceiling wall 61 to upper portions of side walls 62 (see FIG. 4).

With such a configuration, stimulus to skin S which is brought into contact with crosspieces 210 disposed between slits 300 can be reduced with more certainty.

Figure 24A:
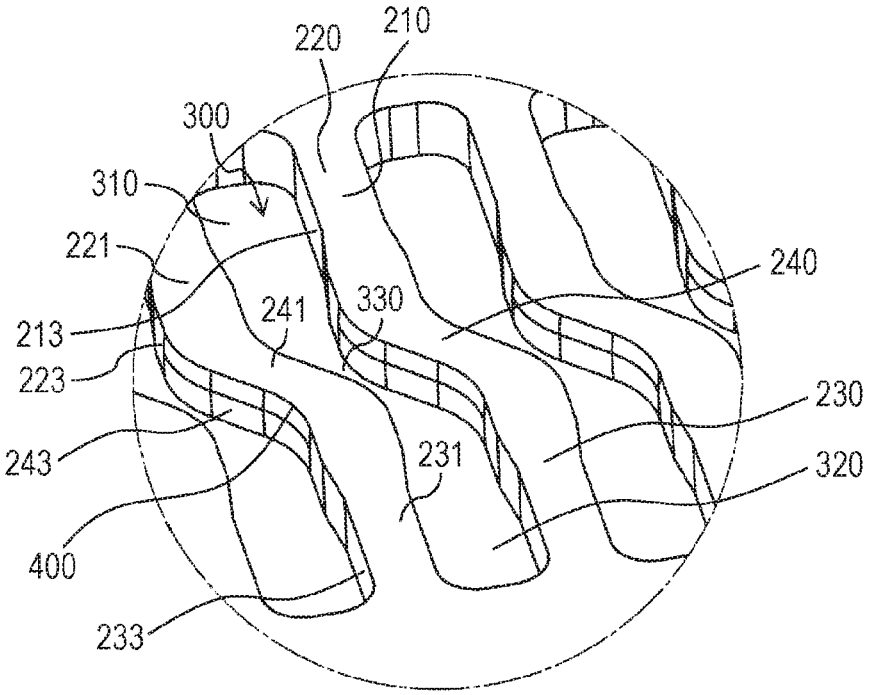
FIG. 24A is a perspective view of a slit outer blade according to a twenty second modification of the exemplary embodiment of the present disclosure.
Figure 24B:
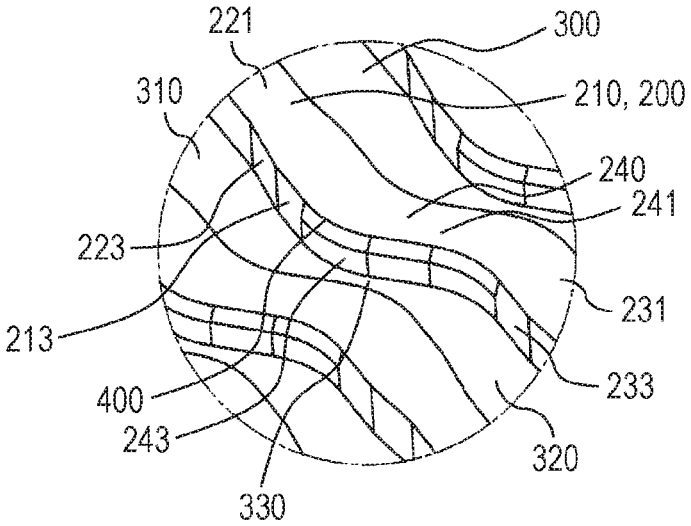
FIG. 24B is an enlarged perspective view of a connecting crosspiece portion of the slit outer blade according to the twenty second modification of the exemplary embodiment of the present disclosure.

As shown in FIG. 24A and FIG. 24B, each side surface 243 of connecting crosspiece portion 240 (a portion where first hair lifting portion 400 is formed) and each side surface 223, 233 of first crosspiece portion 220 and second crosspiece portion 230 (a portion where first hair lifting portion 400 is not formed) may be connected to each other thus forming a smooth curved surface.

When first hair lifting portions 400 are simply formed on connecting crosspiece portion 240, as shown in FIG. 22A, a discontinuous surface is formed between side surface 223 and side surface 243 or between side surface 233 and side surface 243. When the discontinuous surfaces are formed in this manner, there is a possibility that body hair H is caught by the discontinuous surface thus deteriorating shaving comfort or a possibility that skin S is stimulated by the discontinuous surface.

On the other hand, when crosspieces 210 are formed into a shape shown in FIG. 24A and FIG. 24B, it is possible to suppress the formation of a discontinuous surface on side surfaces 213 of crosspieces 210 and hence, stimulus to skin S can be reduced whereby more smooth shaving comfort can be acquired.

Figure 25B:
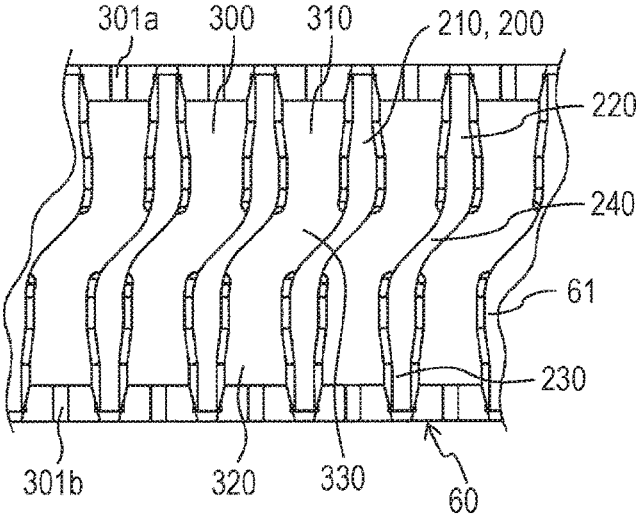
FIG. 25B is a plan view showing a slit outer blade according to the twenty third modification of the exemplary embodiment of the present disclosure.
Figure 25C:
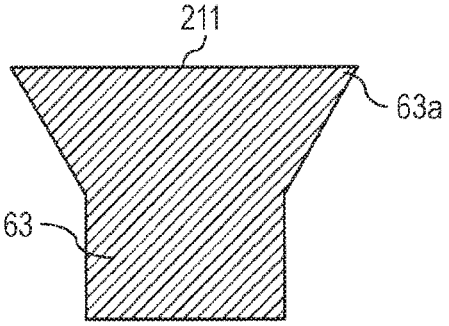
FIG. 25C is a cross-sectional view of a connecting portion between a ceiling wall and a side wall of the slit outer blade according to the twenty third modification of the exemplary embodiment of the present disclosure.

As shown in FIG. 25A to FIG. 25C, second hair lifting portion 63*a* may be formed on the skin contact surface (outer surface) 211 side of each connecting portion 63 between ceiling wall 61 and side wall 62. A cross-sectional shape of connecting portion 63 shown in FIG. 25C is substantially equal to a shape shown in FIG. 14A.

By forming second hair lifting portion 63*a* on the skin contact surface (outer surface) 211 side of each connecting portion 63 between ceiling wall 61 and side wall 62 in this manner, body hair H introduced from the side wall 62 side can be lifted by second hair lifting portions 63*a* disposed on connecting portion 63 side and hence, body hair H can be shaved more efficiently.

As has been described heretofore, electric shaver 10 according to this exemplary embodiment includes: slit outer blade 60 that has a predetermined length and a predetermined width and is configured to be brought into contact with skin (skin surface) S; and slit inner blade 90 that is disposed on a side opposite to a side where slit outer blade 60 is brought into contact with skin S, and is displaced relative to slit outer blade 60.

Slit outer blade 60 has the plurality of slits 300 which extend in longitudinal direction (the width direction of the outer blade) X and into which body hair H is introduced. Slits 300 are arranged at predetermined intervals in lateral direction (the length direction of the outer blade) Y.

Slit 300 includes: first slit portion 310 positioned on one end side of slit outer blade 60 in longitudinal direction (the width direction of the outer blade) X; second slit portion 320 positioned on the other end side of slit outer blade 60 in longitudinal direction (the width direction of the outer blade) X in a displaced manner from first slit portion 310 in lateral direction (the length direction of the outer blade) Y; and connecting slit portion 330 connecting first slit portion 310 to second slit portion 320.

Displacement width W1 in lateral direction (the length direction of the outer blade) Y between first slit portion 310 and second slit portion 320 is set equal to or larger than at least one of widths W2 of connecting portions 311, 321 of first slit portion 310 and second slit portion 320 connected to connecting slit portion 330.

With such a configuration, when slit outer blade 60 is moved in longitudinal direction (the width direction of the outer blade: the length direction of the slit) X in a state where body hair H lying flat against skin S is introduced into slits 300, body hair H can be brought into contact with a peripheral edge portion (connecting crosspiece portion 240) of connecting slit portion 330 with more certainty. As a result, body hair H lying flat against skin S can be lifted with more certainty so that body hair H can be introduced into an area closer to the slit inner blade 90 side than contact surfaces (sliding surfaces: inner surface 200*b* and outer surface 90*a*) between slit inner blade 90 and slit outer blade 60 whereby body hair H can be shaved more efficiently.

Connecting slit portion 330 may be formed such that an angle made by connecting slit portion 330 and lateral direction (outer blade length direction) Y is set to a value which falls within a range from 0° to 45° inclusive.

With such a configuration, when slit outer blade 60 is moved in longitudinal direction (the width direction of the outer blade: the length direction of the slit) X in a state where body hair H lying flat against skin S is introduced into slits 300, it is possible to suppress lateral sliding of body hair H which is brought into contact with the peripheral edge portion (connecting crosspiece portion 240) of connecting slit portion 330 and hence, body hair H lying flat against skin S can be lifted with more certainty.

Bent portion 302 may be formed on connecting portion 311, 321 between at least one of first and second slit portions 310, 320 and connecting slit portion 330 as viewed from a side where slit outer blade 60 is brought into contact with skin S.

With such a configuration, it is possible to reduce stimulus to skin S which is brought into contact with the peripheral edge portion (at least one of connecting portion 311 and connecting portion 321) of slit 300.

Between each two slits 300, 300 disposed adjacently to each other in lateral direction (the length direction of the outer blade) Y, crosspiece 210 extending in longitudinal direction (the width direction of the outer blade) X may be formed along slits 300, 300.

Crosspiece 210 may include: first crosspiece portion 220 disposed adjacently to first slit portions 310; second crosspiece portion 230 disposed adjacently to second slit portions 320; and connecting crosspiece portion 240 disposed adjacently to connecting slit portion 330 and configured to connect first crosspiece portion 220 to second crosspiece portion 230.

Each crosspiece 210 may have: skin contact surface (outer surface) 211 which is brought into contact with skin S; inner surface 212 which faces slit inner blade 90 on the side opposite to skin contact surface (outer surface) 211; and side surfaces 213 which connect skin contact surface (outer surface) 211 to inner surface 212.

First hair lifting portions 400 may be formed on edge portions (skin contact surface side end portions 244) on the skin contact surface (outer surface) 241 side of connecting crosspiece portion 240.

With such a configuration, body hair H lying flat against skin S can be lifted with more certainty.

Connecting crosspiece portion 240 may be formed in a stepped shape as viewed from the skin contact surface 200*a* side.

With such a configuration, lateral sliding of body hair H can be further prevented and hence, body hair H lying flat against skin S can be lifted with more certainty.

First hair lifting portion 400 may have first projecting portion 420 projecting toward connecting slit portion 330.

With such a configuration, body hair H lying flat against skin S can be lifted with more certainty with a simpler structure.

First hair lifting portion 400 may include acute-angled portion 430 where an angle made by skin contact surface (outer surface) 241 of connecting crosspiece portion 240 and whole (a part of or whole) side surface 243 of connecting crosspiece portion 240 is an acute angle.

With such a configuration, a distal end of first hair lifting portion 400 can be easily slid into a space between skin S and body hair H lying flat against skin S and hence, body hair H lying flat against skin S can be lifted with more certainty.

First projecting portions 420 may be formed by fixing projecting member 440 which is a member separate from connecting crosspiece portion 240 to connecting crosspiece portion 240.

With such a configuration, body hair H lying flat against skin S can be lifted with more certainty and stimulus to skin S which is caused by first hair lifting portions 400 can be reduced. Particularly, by forming first hair lifting portions 400 using a material which has sufficient elasticity, stimulus to skin S which is caused by first hair lifting portions 400 can be further reduced.

The edge portion (distal end 410) of first hair lifting portion 400 may have first rounded portion 411 where a corner is rounded.

With such a configuration, body hair H lying flat against skin S can be lifted with more certainty and stimulus to skin S which is caused by first hair lifting portions 400 can be reduced.

A radius of curvature of first rounded portion 411 of first hair lifting portion 400 (a radius of curvature of first rounded portion 411 when connecting crosspiece portion 240 is viewed in a cross-sectional view taken along the direction orthogonal to the extending direction of connecting crosspiece portion 240) is preferably set to a value which falls within a range from 20 μm to 60 μm inclusive.

With such a configuration, stimulus to skin S which is caused by first hair lifting portions 400 can be reduced while suppressing lowering of a hair lifting force.

Edge portions (skin contact surface side end portions 224 and skin contact surface side end portion 234) of skin contact surfaces (outer surfaces) 221, 231 of first crosspiece portion 220 and second crosspiece portion 230 (portions where first hair lifting portion 400 is not formed) may have second rounded portions 520 where a corner is rounded.

With such a configuration, stimulus to skin S which is brought into contact with crosspieces 210 can be reduced with more certainty.

Distal ends 410 of first hair lifting portion 400 may be positioned more on the slit inner blade 90 side than skin contact surface (outer surface) 241 is.

With such a configuration, stimulus to skin S which is caused by first hair lifting portions 400 can be reduced.

Second projecting portion 250 projecting toward the skin S side may be formed in the vicinity of boundaries (connecting portion 331*a*, 331*b*, 331*c*, 331*d*) between connecting crosspiece portion 240 (a portion of crosspiece 210 where first hair lifting portions 400 are formed) and first crosspiece portion 220 and second crosspiece portion 230 (portions where first hair lifting portion 400 is not formed).

Skin contact surface (outer surface) 241 of each connecting crosspiece portion 240 (a portion of crosspiece 210 where first hair lifting portions 400 are formed) may be positioned more on the slit inner blade 90 side than skin contact surfaces (outer surfaces) 221, 231 of first crosspiece portion 220 and second crosspiece portion 230 (a portion where first hair lifting portion 400 is not formed) are.

With such a configuration, in regions where first hair lifting portions 400 are formed, a contact pressure to skin S can be reduced and hence, stimulus to skin S which is caused by first hair lifting portions 400 can be reduced.

Each side surface 243 of connecting crosspiece portion 240 where first hair lifting portion 400 is formed and side surface 223 of first crosspiece portion 220 where first hair lifting portion 400 is not formed and side surface 233 of second crosspiece portion 230 where first hair lifting portion 400 is not formed may be smoothly connected to each other.

With such a configuration, it is possible to suppress the formation of a discontinuous surface on side surfaces 213 of crosspiece 210 and hence, stimulus to skin S can be reduced whereby more smooth shaving comfort can be acquired.

As viewed from a side where slit outer blade 60 is brought into contact with skin S, first hair lifting portion 400 may be disposed at a position where first hair lifting portion 400 overlaps with slit inner blade 90.

With such a configuration, it is possible to suppress that body hair H lifted by first hair lifting portion 400 is laid down again before body hair H reaches a region where body hair H can be cut and hence, body hair H can be shaved with more certainty.

On side surface (at least on side surfaces of a portion of crosspiece 210 where first hair lifting portions 400 are formed) 243 of connecting crosspiece portion 240, groove portions 246 which extend from the skin contact surface (outer surface) 241 side to the inner surface 242 side may be formed.

With such a configuration, body hair H can be easily moved along groove portions 246 so that body hair H lying flat against skin S can be lifted with more certainty.

An angle made by inner surface 242 of connecting crosspiece portion 240 and a part of or the whole side surface 243 of connecting crosspiece portion 240 may be set to 90° or more.

For example, when the angle made by inner surface 242 of connecting crosspiece portion 240 and a part of or the whole side surface 243 of connecting crosspiece portion 240 is set to an acute angle, in introducing body hair H into an area closer to the slit inner blade 90 side than sliding surfaces (inner surface 200*b* and outer surface 90*a*), body hair H impinges on an acute-angled portion of an edge portion (inner surface side end portion 245) on the inner surface side. Accordingly, there may be a case where the introduction of body hair H into an area closer to the slit inner blade 90 side than sliding surfaces (inner surface 200*b* and outer surface 90*a*) is obstructed by the acute-angled portion of the edge portion (inner surface side end portion 245) on the inner surface side.

On the other hand, by setting an angle made by inner surface 242 of connecting crosspiece portion 240 and a part of or the whole side surface 243 of connecting crosspiece portion 240 to 90° or more, it is possible to suppress that body hair H impinges on an edge portion on the inner surface side (inner surface side end portion 245). Accordingly, it is possible to suppress the occurrence of a phenomenon where the introduction of body hair H into an area closer to the slit inner blade 90 side than sliding surfaces (inner surface 200*b* and outer surface 90*a*) is obstructed by edge portion (inner surface side end portion 245) on the inner surface side. As a result, body hair H can be smoothly introduced into an area closer to the slit inner blade 90 side than sliding surfaces (inner surface 200*b* and outer surface 90*a*) and hence, body hair H can be shaved more efficiently.

Further, each inner surface side end portion 245 of connecting crosspiece portion 240 may have obtuse-angled portion 500 where an angle is set to an obtuse angle.

With such a configuration, side surfaces 243 of connecting crosspiece portion 240 may form inclined surfaces which are inclined toward the skin contact surface (outer surface) 241 side and outward (toward the connecting slit portion 330 side). As described above, by inclining side surfaces 243 of connecting crosspiece portion 240 toward the skin contact surface (outer surface) 241 side and outward (toward the connecting slit portion 330 side), in introducing body hair H into an area closer to the slit inner blade 90 side than sliding surfaces (inner surface 200*b* and outer surface 90*a*), body hair H can be more smoothly slid along side surfaces (inclined surfaces) 243 from the skin contact surface (outer surface) 241 side to the inner surface 242 side (slit inner blade 90 side). By setting the angle of inner surface side end portion 245 to an obtuse angle, a frictional force generated between inner surface side end portion 245 and body hair H can be reduced. As described above, by setting the angle of each inner surface side end portion 245 of connecting crosspiece portion 240 to an obtuse angle, body hair H can be more smoothly introduced into an area closer to the slit inner blade 90 side than sliding surfaces (inner surface 200*b* and outer surface 90*a*).

The edge portion of each connecting crosspiece portion 240 on the inner surface 242 side may have third rounded portion 510 where a corner is rounded.

Connecting crosspiece portion 240 extends in the direction which intersects with longitudinal direction (the width direction of the outer blade: the length direction of the slit) X so that connecting crosspiece portion 240 forms a portion having a large shear angle at the time of shearing body hair H by slit inner blade 90 and slit outer blade 60.

Accordingly, connecting crosspiece portion 240 is a portion where a cutting failure such as half cut is liable to occur. Half cut is a failure where body hair H is not completely cut and is brought into a half cut state.

By forming third rounded portion 510 where a corner is rounded on the edge portion of connecting crosspiece portion 240 on the inner surface 242 side, cutting of body hair H at connecting crosspiece portion 240 can be suppressed. With such a configuration, while preventing cutting of body hair H at connecting crosspiece portion 240 where a cutting failure such as half cut is liable to occur, body hair H can be shorn by slit inner blade 90 and slit outer blade 60 when body hair H is moved to first slit portion 310 or second slit portion 320.

As described above, by forming third rounded portion 510 where a corner is rounded on edge portions of connecting crosspiece portion 240 on the inner surface 242 side, a cutting failure such as half cut which occurs at the time of cutting body hair H can be suppressed and hence, body hair H can be shaved with more certainty.

Gap D1 may be formed between inner surface 242 of connecting crosspiece portion 240 and slit inner blade 90.

As described above, by forming gap D1 between inner surface 242 of connecting crosspiece portion 240 and slit inner blade 90, cutting of body hair H at connecting crosspiece portion 240 where a cutting failure such as half cut is liable to occur can be suppressed with more certainty. As a result, a cutting failure such as half cut which occurs at the time of cutting body hair H can be suppressed with more certainty.

Slit outer blade 60 may include: ceiling wall 61 facing skin S; and side walls 62 connected to both end portions of ceiling wall 61 in longitudinal direction (the width direction of the outer blade: the length direction of the slit) X, and extending toward the slit inner blade 90 side (the direction away from skin 5).

Slits 300 may be formed in slit outer blade 60 in an extending manner from one side wall 62 to the other side wall 62 in longitudinal direction (the width direction of the outer blade: the length direction of the slit) X.

Second hair lifting portion 63*a* may be formed on the skin contact surface (outer surface) 211 side of each connecting portion 63 between ceiling wall 61 and side wall 62.

With such a configuration, body hair H introduced from the side wall 62 side can be lifted by second hair lifting portions 63*a* and hence, a larger amount of body hair H can be introduced into an area closer to the slit inner blade 90 side than sliding surfaces (inner surface 200*b* and outer surface 90*a*). As a result, body hair H can be shaved more efficiently.

Although the preferred exemplary embodiment of the present disclosure has been described heretofore, the present disclosure is not limited to the above-mentioned exemplary embodiment, and various modifications are conceivable.

For example, in the above-mentioned exemplary embodiment, electric shaver 10 which includes gripping portion 11 and head portion 12 is exemplified. However, the present disclosure is also applicable to an electric shaver which has no head portion.

Slit blades (slit inner blades and slit outer blades) may be operated in cooperation with a net blade, a trimmer blade, a beard lifting comb, rollers or the like.

In the above-mentioned exemplary embodiment, a case is exemplified where three outer blades including one slit outer blade are arranged parallel to each other. However, it is sufficient for the outer blades to include at least one slit outer blade so that the number of outer blades may be one, two or four or more.

In the above-mentioned exemplary embodiment, plural kinds of slits having different planar shapes are exemplified. However, a planar shape of the slit is not limited to such shapes, and the slit may have various shapes. In the above-mentioned exemplary embodiment, plural kinds of crosspieces having different cross-sectional shapes are exemplified. However, a cross-sectional shape of the crosspiece is not limited to such shapes, and the crosspiece may have various shapes.

The outer blade has slits having a predetermined planar shape and crosspieces having a predetermined cross-sectional shape. A desired combination of a planar shape of the slits and a cross-sectional shape of the crosspieces may be adopted. For example, slits may have a planar shape shown in FIG. 7A, and connecting crosspiece portions may have a cross-sectional shape shown in FIG. 19A.

A specification (shape, size, layout or the like) of the outer blades, the inner blade, and other details may be changed as desired.

As has been described heretofore, the electric shaver according to the present disclosure includes: the outer blade that has a predetermined length and a predetermined width, and is configured to be brought into contact with a skin; and the inner blade that is disposed on a side opposite to a side where the outer blade is brought into contact with the skin, and is displaced relative to the outer blade.

The outer blade has a plurality of slits that extend in a width direction of the outer blade and into which body hair is introduced. The slits are arranged at predetermined intervals in a length direction of the outer blade.

Each of the slits includes: the first slit portion positioned on the one end side of the outer blade in the width direction; the second slit portion positioned on the other end side of the outer blade in the width direction in a displaced manner from the first slit portion in the length direction of the outer blade; and the connecting slit portion connecting the first slit portion to the second slit portion.

A displacement width in the length direction of the outer blade between the first slit portion and the second slit portion is set equal to or larger than at least one of widths of connecting portions of the first slit portion and the second slit portion connected to the connecting slit portion.

With such a configuration, when the outer blade is moved in the width direction of the outer blade in a state where body hair lying flat against the skin is introduced into the slits, body hair can be brought into contact with a peripheral edge portion of the connecting slit portion with more certainty. As a result, body hair lying flat against the skin can be lifted with more certainty so that body hair can be introduced into an area closer to the inner blade side than contact surfaces (sliding surfaces: a portion where body hair is cut by the inner blade and the outer blade) between the inner blade and the outer blade whereby body hair can be shaved more efficiently.

The connecting slit portion may be formed such that an angle made by the connecting slit portion and the length direction of the outer blade is set to a value which falls within a range from 0° to 45° inclusive.

With such a configuration, when the outer blade is moved in the width direction of the outer blade in a state where body hair lying flat against the skin is introduced into the slits, it is possible to suppress lateral sliding of body hair which is brought into contact with a peripheral edge portion of the connecting slit portion and hence, body hair lying flat against the skin can be lifted with more certainty.

A bent portion may be formed on a connecting portion between at least one of the first slit portion and the second slit portion and the connecting slit portion as viewed from a side where the outer blade is brought into contact with skin.

With such a configuration, it is possible to reduce stimulus to skin which is brought into contact with the peripheral edge portion of the slit.

Between each two slits disposed adjacently to each other in the length direction of the outer blade, the crosspiece extending in the width direction of the outer blade may be formed along these slits.

The crosspiece may include: the first crosspiece portion disposed adjacently to the first slit portions; the second crosspiece portion disposed adjacently to the second slit portions; and connecting crosspiece portion disposed adjacently to the connecting slit portion and configured to connect the first crosspiece portion to the second crosspiece portion.

Each crosspiece may have: the outer surface which is brought into contact with skin; the inner surface which faces the inner blade on the side opposite to the outer surface; and the side surfaces which connect the outer surface to the inner surface.

The first hair lifting portion may be formed on the edge portions of the connecting crosspiece portion on the outer surface side.

With such a configuration, body hair lying flat against the skin can be lifted with more certainty.

The first hair lifting portion may have the first projecting portion projecting toward the connecting slit portion.

With such a configuration, body hair lying flat against the skin can be lifted with more certainty with a simpler structure.

The first hair lifting portion may include the acute-angled portion where an angle made by the outer surface of the connecting crosspiece portion and a part of or the whole side surface of the connecting crosspiece portion is an acute angle.

With such a configuration, the distal end of the first hair lifting portion can be easily slid into a space between skin and body hair lying flat against the skin and hence, body hair lying flat against the skin can be lifted with more certainty.

The edge portion of the first hair lifting portion may have the first rounded portion where a corner is rounded.

With such a configuration, body hair lying flat against the skin can be lifted with more certainty and stimulus to skin which is caused by the first hair lifting portions can be reduced.

A radius of curvature of the first rounded portion of the first hair lifting portion (a radius of curvature of the first rounded portion when the connecting crosspiece portion is viewed in a cross-sectional view taken along the direction orthogonal to the extending direction of the connecting crosspiece portion) may be set to a value which falls within a range from 20 μm to 60 μm inclusive.

With such a configuration, stimulus to skin which is caused by the first hair lifting portions can be reduced while suppressing lowering of a hair lifting force.

The edge portions on the outer surface side of portions of the crosspiece where the first hair lifting portion is not formed may have the second rounded portion where a corner is rounded.

With such a configuration, stimulus to skin which is brought into contact with the crosspiece can be reduced with more certainty.

The second projecting portion projecting toward a skin side may be formed in the vicinity of boundaries between the portion of the crosspiece where the first hair lifting portions are formed and the portion of the crosspiece where the first hair lifting portion is not formed.

The outer surface of the portion of the crosspiece where the first hair lifting portions are formed may be positioned more on the inner blade side than the outer surface of the portion of the crosspiece where the first hair lifting portion is not formed.

With such a configuration, in regions where the first hair lifting portions are formed, a contact pressure to skin can be reduced and hence, stimulus to skin which is caused by the first hair lifting portions can be reduced.

Each side surface of the connecting crosspiece portion having the first hair lifting portions may be smoothly connected to the side surface of the first crosspiece portion and the side surface of the second crosspiece portion both having no first hair lifting portion.

With such a configuration, it is possible to suppress the formation of a discontinuous surface on the side surfaces of the crosspiece and hence, stimulus to skin can be reduced whereby more smooth shaving comfort can be acquired.

As viewed from a side where the outer blade is brought into contact with skin, the first hair lifting portion may be disposed at a position where the first hair lifting portion overlaps with the inner blade.

With such a configuration, it is possible to suppress that body hair lifted by the first hair lifting portion is laid down again before body hair reaches a region where body hair can be cut and hence, body hair can be shaved with more certainty.

On the side surface of the portion of the crosspiece where the first hair lifting portions are formed, the groove portions which extend from the outer surface side to the inner surface side may be formed.

With such a configuration, body hair can be easily moved along the groove portions so that body hair lying flat against the skin can be lifted with more certainty.

An angle made by the inner surface of the connecting crosspiece portion and a part of or the whole side surface of the connecting crosspiece portion may be set to 90° or more.

For example, when the angle made by the inner surface of the connecting crosspiece portion and a part of or the whole side surface of the connecting crosspiece portion is set to an acute angle, in introducing body hair into an area closer to the inner blade side than the sliding surfaces, body hair impinges on the acute-angled portion of the edge portion on the inner surface side. Accordingly, there may be a case where the introduction of body hair into an area closer to the inner blade side than the sliding surfaces is obstructed.

On the other hand, by setting the angle made by the inner surface of the connecting crosspiece portion and a part of or the whole side surface of the connecting crosspiece portion to 90° or more, it is possible to suppress that body hair impinges on the edge portion on the inner surface side. Accordingly, it is possible to suppress the occurrence of a phenomenon where the introduction of body hair into an area closer to the inner blade side than the sliding surfaces is obstructed by the edge portions on the inner surface side. As a result, body hair can be smoothly introduced into an area closer to the inner blade side than the sliding surfaces and hence, body hair can be shaved more efficiently.

The edge portion of each connecting crosspiece portion on the inner surface side may have the third rounded portion where a corner is rounded.

The connecting crosspiece portion extends in the direction which intersects with the width direction of the outer blade so that the connecting crosspiece portion forms a portion having a large shear angle at the time of shearing body hair by the inner blade and the outer blade.

Accordingly, the connecting crosspiece portion is a portion where a cutting failure such as half cut is liable to occur. Half cut is a failure where body hair is not completely cut and is brought into a half cut state.

By forming the third rounded portion where a corner is rounded on edge portions of the connecting crosspiece portion on the inner surface side, cutting of body hair at the connecting crosspiece portion can be suppressed. With such a configuration, while preventing cutting of body hair at the connecting crosspiece portion where a cutting failure such as half cut is liable to occur, body hair can be shorn by the inner blade and the outer blade when body hair is moved to the first slit portion or the second slit portion.

By forming the third rounded portions where a corner is rounded on the edge portions of the connecting crosspiece portion on the inner surface side in this manner, a cutting failure such as half cut which occurs at the time of cutting body hair can be suppressed and hence, body hair can be shaved with more certainty.

A gap may be formed between the inner surface of the connecting crosspiece portion and the inner blade.

By forming the gap between the inner surface of the connecting crosspiece portion and the inner blade in this manner, cutting of body hair at the connecting crosspiece portion where a cutting failure such as half cut is liable to occur can be suppressed with more certainty. As a result, a cutting failure such as half cut which occurs at the time of cutting body hair can be suppressed with more certainty.

The outer blade may include: the ceiling wall facing a skin; and side walls connected to both end portions of the ceiling wall in the width direction of the outer blade, and extending in the direction away from the skin.

The slits may be formed in the outer blade such that the slits extend from one side wall to the other side wall in the length direction of the outer blade.

The second hair lifting portion may be formed on a skin side of each connecting portion between the ceiling wall and the side wall.

With such a configuration, body hair introduced from the side wall side can be lifted by the second hair lifting portions and hence, a larger amount of body hair can be introduced into an area closer to the inner blade side than the sliding surfaces. As a result, body hair can be shaved more efficiently.

What is claimed is:

1. An electric shaver comprising:

an outer blade that has a predetermined length and a predetermined width, and is configured to be brought into contact with a skin; and an inner blade that is disposed on a side opposite to a side where the outer blade is brought into contact with the skin and is displaced relative to the outer blade, wherein the outer blade has a plurality of slits that extend in a width direction of the outer blade and into which body hair is introduced, the slits being arranged at predetermined intervals in a length direction of the outer blade, each of the slits includes: a first slit portion positioned on a first end portion side of the outer blade in the width direction; a second slit portion positioned on a second end portion side of the outer blade in the width direction in a displaced manner from the first slit portion in the length direction of the outer blade; and a connecting slit portion connecting the first slit portion to the second slit portion, a displacement width in the length direction of the outer blade between the first slit portion and the second slit portion is set equal to or larger than at least one of widths of connecting portions of the first slit portion and the second slit portion connected to the connecting slit portion, a crosspiece extending in the width direction of the outer blade is formed along the slits between the slits disposed adjacently to each other in the length direction of the outer blade, the crosspiece is formed of:

a first crosspiece portion disposed adjacently to the first slit portions;

a second crosspiece portion disposed adjacently to the second slit portions; and a connecting crosspiece portion disposed adjacently to the connecting slit portions and configured to connect the first crosspiece portion to the second crosspiece portion, the crosspiece has an outer surface disposed on a side where the crosspiece is brought into contact with the skin, an inner surface disposed on a side where the crosspiece faces the inner blade on a side opposite to the outer surface, and side surfaces which connect the outer surface to the inner surface, a first hair lifting portion is formed on an edge portion of the connecting crosspiece portion on an outer surface side, and the first hair lifting portion has an acute-angled portion where an angle made by an outer surface, which is disposed on a side where the crosspiece is brought into contact with the skin, of the connecting crosspiece portion and a part of or a whole side surface of the connecting crosspiece portion is an acute angle.

2. The electric shaver according to claim 1, wherein an angle made by the connecting slit portion and the length direction of the outer blade is set to a value which falls within a range from 0° to 45° inclusive.

3. The electric shaver according to claim 1, wherein a bent portion is formed on the connecting portion between at least one of the first slit portion and the second slit portion and the connecting slit portion as viewed from a side where the outer blade is brought into contact with the skin.

4. The electric shaver according to claim 1, wherein an edge portion of the first hair lifting portion has a first rounded portion where a corner is rounded.

5. The electric shaver according to claim 4, wherein a radius of curvature of the first rounded portion is set to a value which falls within a range from 20 μm to 60 μm inclusive.

6. The electric shaver according to claim 1, wherein an edge portion on an outer surface side of a portion of the crosspiece where the first hair lifting portion is not formed has a second rounded portion where a corner is rounded.

7. The electric shaver according to claim 1, wherein a second projecting portion projecting toward a skin side is formed in a vicinity of a boundary between a portion of the crosspiece where the first hair lifting portion is formed and a portion of the crosspiece where the first hair lifting portion is not formed.

8. The electric shaver according to claim 1, wherein an outer surface of a portion of the crosspiece where the first hair lifting portion is formed is positioned closer to the inner blade than an outer surface of a portion of the crosspiece where the first hair lifting portion is not formed is.

9. The electric shaver according to claim 1, wherein a side surface of the connecting crosspiece portion where the first hair lifting portion is formed and a side surface of the first crosspiece portion where the first hair lifting portion is not formed and a side surface of the second crosspiece portion where the first hair lifting portion is not formed are smoothly connected to each other.

10. The electric shaver according to claim 1, wherein the first hair lifting portion is disposed at a position where the first hair lifting portion overlaps with the inner blade as viewed from a side where the outer blade is brought into contact with the skin.

11. The electric shaver according to claim 1, wherein a groove portion extending from an outer surface side to an inner surface side is formed on a side surface of a portion of the crosspiece where the first hair lifting portion is formed.

12. The electric shaver according to claim 1, wherein an angle made by an inner surface of the connecting crosspiece portion and a part of or a whole side surface of the connecting crosspiece portion is set to 90° or more.

13. The electric shaver according to claim 12, wherein an edge portion of the connecting crosspiece portion on an inner surface side has a third rounded portion where a corner is rounded.

14. The electric shaver according to claim 1, wherein a gap is formed between an inner surface of the connecting crosspiece portion and the inner blade.

15. The electric shaver according to claim 1, wherein the outer blade includes a ceiling wall which faces the skin and side walls connected to both end portions of the ceiling wall in the width direction of the outer blade, and extending in a direction away from the skin, each of the slits is formed in an extending manner from one side wall to the other side wall in the length direction of the outer blade, and a second hair lifting portion is formed on a skin side of a connecting portion between the ceiling wall and the side wall.

16. An outer blade that has a predetermined length and a predetermined width, and is configured to be brought into contact with a skin, the outer blade comprising:

a plurality of slits that extend in a width direction of the outer blade and into which body hair is introduced, the slits being arranged at predetermined intervals in a length direction of the outer blade; and a crosspiece extending in the width direction of the outer blade formed along the slits between the slits disposed adjacently to each other in the length direction of the outer blade, wherein:

each of the slits includes: a first slit portion positioned on a first end portion side of the outer blade in the width direction; a second slit portion positioned on a second end portion side of the outer blade in the width direction in a displaced manner from the first slit portion in the length direction of the outer blade; and a connecting slit portion connecting the first slit portion to the second slit portion, a displacement width in the length direction of the outer blade between the first slit portion and the second slit portion is set equal to or larger than at least one of widths of connecting portions of the first slit portion and the second slit portion connected to the connecting slit portion, the crosspiece is formed of:

a first crosspiece portion disposed adjacently to the first slit portions;

a second crosspiece portion disposed adjacently to the second slit portions; and a connecting crosspiece portion disposed adjacently to the connecting slit portions and configured to connect the first crosspiece portion to the second crosspiece portion, the crosspiece has an outer surface disposed on a side where the crosspiece is brought into contact with the skin, an inner surface disposed on a side where the crosspiece faces the inner blade on a side opposite to the outer surface, and side surfaces which connect the outer surface to the inner surface, a first hair lifting portion is formed on an edge portion of the connecting crosspiece portion on an outer surface side, and the first hair lifting portion has an acute-angled portion where an angle made by an outer surface, which is disposed on a side where the crosspiece is brought into contact with the skin, of the connecting crosspiece portion and a part of or a whole side surface of the connecting crosspiece portion is an acute angle.

* * * * *